United States Patent [19]

Rhoads

[11] Patent Number: 4,854,164

[45] Date of Patent: Aug. 8, 1989

[54] ROD PUMP OPTIMIZATION SYSTEM

[75] Inventor: Benjamin J. Rhoads, Dallas, Tex.

[73] Assignee: N/COR Inc., Arlington, Tex.

[21] Appl. No.: 191,381

[22] Filed: May 9, 1988

[51] Int. Cl.[4] ..... E21B 44/00

[52] U.S. Cl. ..... 73/155; 73/863.03; 166/53; 417/36; 417/44

[58] Field of Search ..... 73/151, 155, 863.02, 73/863.03, 864.34; 417/36, 44; 166/53, 68.5

[56] References Cited

U.S. PATENT DOCUMENTS

| | | | |
|---|---|---|---|
| 2,316,494 | 4/1943 | Tipton | 103/25 |
| 2,550,093 | 4/1951 | Smith | 103/25 |
| 2,876,641 | 3/1959 | Brown | 73/221 |
| 3,021,709 | 2/1962 | Walker et al. | 73/200 |
| 3,135,113 | 6/1964 | Walker et al. | 73/200 |
| 3,145,565 | 6/1964 | Smith et al. | 73/200 |
| 3,392,580 | 7/1968 | Bain et al. | 73/215 |
| 3,838,597 | 10/1974 | Montgomery et al. | 73/151 |
| 3,864,060 | 2/1975 | Hall, Jr. et al. | 417/36 |
| 3,930,752 | 1/1976 | Douglas | 417/12 |
| 3,998,568 | 12/1976 | Hynd | 417/12 |
| 4,015,469 | 4/1977 | Womack | 73/151 |
| 4,034,808 | 7/1977 | Patterson | 166/250 |
| 4,058,757 | 11/1977 | Welton et al. | 318/474 |
| 4,318,674 | 3/1982 | Godbey et al. | 417/36 |
| 4,470,316 | 9/1984 | Jiskoot | 73/864.34 |
| 4,507,055 | 3/1985 | Fair et al. | 417/12 |
| 4,583,915 | 4/1986 | Montgomery et al. | 417/26 |

*Primary Examiner*—Stewart J. Levy
*Assistant Examiner*—Kevin D. O'Shea

[57] ABSTRACT

An apparatus for measuring the quantity and flow rate of liquids in a flowing fluid stream containing liquids and gases such as found in oil well production, with an optional controller for oil well pumps to control the pumping period or speed based on pump displacement. Total number of tank fill events provide a precise measurement of total volume. Volumes are accumulated on a time base to determine flow rate and on the basis of strokes to determine pump displacement. Liquid measurement is accomplished without restriction to the flowing stream, even in the event of a valve failure. The filling of each tank with oil of low or high viscosity can be measured by level, hydrostatic pressure, or weight sensors. Measurement of total produced volumes are accumulated with the accuracy and repeatability needed when correlating producing wells with injection wells, and when diagnosing well problems. Flow rate or subsurface pump displacement is used to provide a means for pump-off control without the adjustment and calibration problems inherent in load sensing pump-off control systems. Combined pump-off and production measurements permit routine adjustment of idle-time when pumping period is controlled while flow and pump rates permit pump displacement measurements which are fundamental to effective speed control.

22 Claims, 19 Drawing Sheets

TYPICAL PUMPING CYCLE--USING INTERVAL TIMER TO CONTROL START STOP OF PUMP SYSTEM

Figure 1:
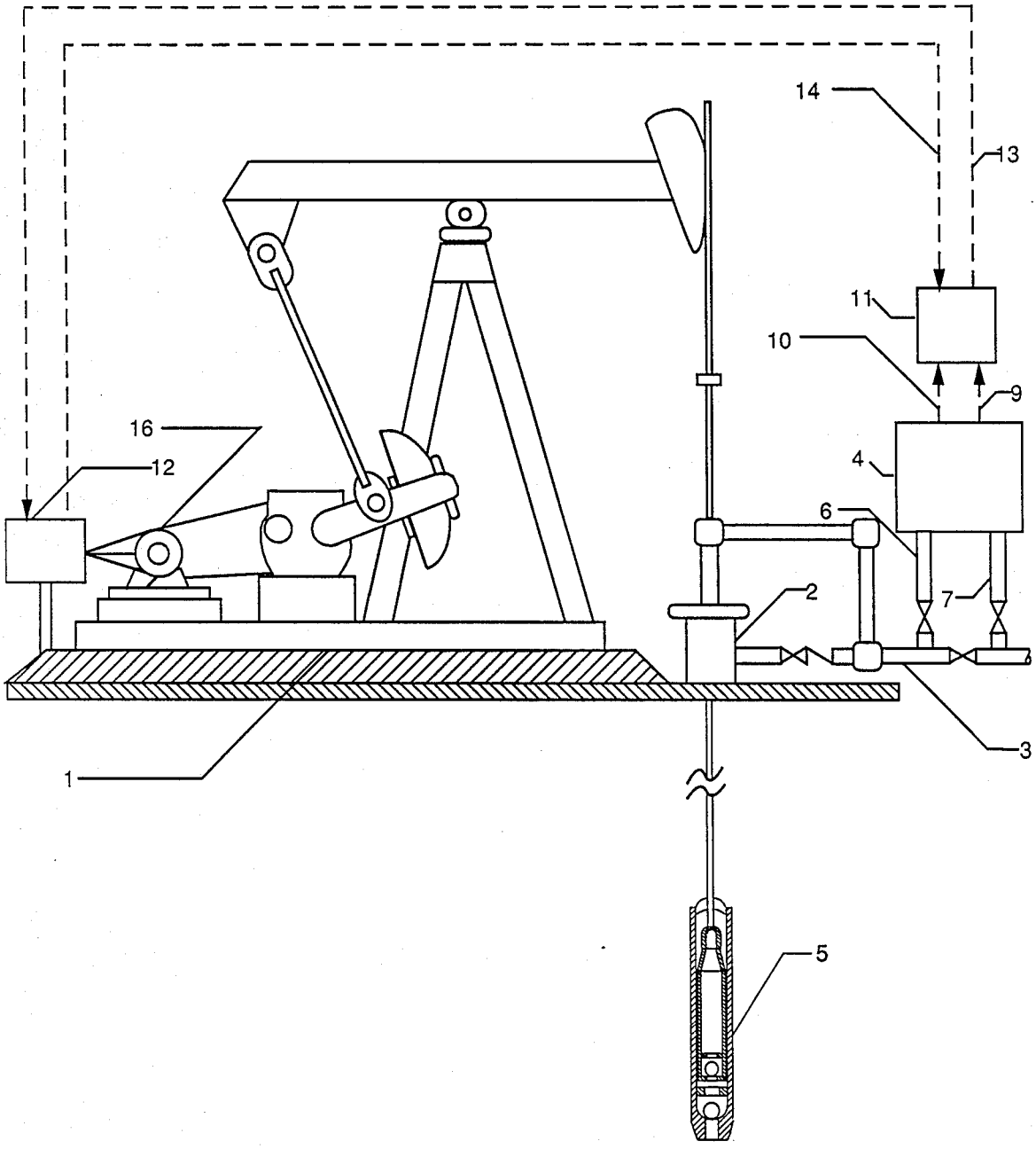

TYPICAL PUMPING CYCLE--USING DEVIATION IN PUMP DISPLACEMENT TO AUTOMATICALLY CONTROL START-STOP OF PUMP CYCLE

ROD PUMP OPTIMIZATION SYSTEM

The present invention relates to the measurement of oil well liquids both for the purpose of optimizing the performance of a rod pumping system which lifts well fluids from the subsurface well bore to the surface and for the purpose of providing oil well production information beneficial to the optimum management of daily production and to many type of secondary and enhanced recovery programs utilized to recover oil in place in the reservoir.

BACKGROUND OF THE INVENTION

Optimizing oil well operations has been a challenge since the drilling of the first oil well. When wells produce oil over some time period, reservoir pressures decline and some form of artificial lift (pumps, gas lift, etc.) is required to lift reservoir liquids accumulating in the subsurface well bore to the surface. In the United States, the predominant form of artificial lift is the rod pumping system whereby a string of rods connected to a subsurface pump moves the plunger of the subsurface pump in a reciprocating motion to lift well fluids accumulating in the well bore.

The three principle problems encountered in the management of a rod pumping system are as follows:

(1) Adjusting the capacity of the pump to the ability of the reservoir to deliver fluids from the reservoir to the well bore.

(2) The identification of inefficiencies in the well pumping system to effect remedial efforts before such inefficiencies result in excessive cost and/or lost production.

(3) The identification of reservoir problems that restrict the flow of fluids from the reservoir to the well bore so that remedies may be implemented to restore reservoir performance when such remedies are economical.

If both reservoir deliverabilities and pumping capacity were constant, if would probably be feasible to manually adjust pumping capacity to equal that of reservoir deliverability. In practice, neither is constant. Reservoir deliverability changes because of many factors some of which are as follows:

(1) Changing reservoir pressures due to depletion of fluids from the reservoir or the injection of fluids from external sources into the reservoir or both.

(2) Changing well bore permeabilities because of deposition of foreign materials in pore spaces of the reservoir.

(3) changing reservoir fluid characteristics that restrict or enhance the flow of fluids from the reservoir to the well bore.

Pump capacities change because of wear on component parts—pump plunger, barrel, balls and seats, or other components. Pump capacities may also change because of the deposition of material (scale/paraffin) in or around the pump barrel so as to restrict the entry of well fluids from the well bore into the pump barrel on the upstroke of the pump.

Present efforts to adjust rod pumping capacities to reservoir deliverabilities has, for the most part, consisted of controlling the percentage of time the pumping system operates over some specific time period. Usually, the percentage of time that a pumping well operates is manually adjusted with a percentage or interval timer. Because the well operator wishes to be sure that the well produces all the oil or revenue that the reservoir is capable of delivering, he will adjust the time the well pumps slightly in excess of reservoir deliverability. This excess pumping capacity, to assure maximum production, results in both an increased amount of electrical power required to lift the oil and increased wear and tear on the pumping system over that required under ideal conditions. Also, since both the pump capacity and reservoir deliverability are continually changing, frequent testing or monitoring of the well and the lift system is required to be sure that the well is producing at maximum rates and the lift system is operating near maximum efficiency.

In practice, keeping the well properly adjusted by manual means is difficult if not impossible. In most cases, if the capacity of a pump is within plus or minus ten percent of reservoir deliverability operators feel that the well is operating within optimum conditions. In reality, such practice results in excess costs or lost production. To alleviate problems caused by over or underpumping, "pump-off" controllers were developed to automatically adjust pumping time to match reservoir deliverability. These controllers provided some means to detecting a "pumped-off" condition and then shutting off the pump for some fixed but adjustable interval to allow liquids to again accumulate in the well bore. "Pumped-off" conditions are defined as those conditions in the pumping resulting in decreased subsurface pump displacement. This condition is usually caused when liquid levels in the well bore or annulus fall to levels at or near the subsurface pump inlet. Such conditions will cause incomplete filling of the pump barrel on the upstroke of the pump which results in decreased pump displacement. This decreased pump displacement is caused by pumping at rates in excess of reservoir deliverability. When a well pumps in excess of reservoir deliverability, liquids which have accumulated in the well bore or annulus when the well was not pumping will eventually fall to a point at or near the subsurface pump inlet. At some point when annulus levels are near the pump inlet, liquids will fail to completely fill the pump barrel on the upstroke of the pump causing a decrease in volumetric displacement.

Liquid levels in the annulus at which incomplete filling or reduced displacement occurs will vary depending on many factors such as pump design, pump speed, reservoir fluid characteristics, or restrictions to flow between the well bore (annulus) and the pump barrel.

The majority of "pump-off" controllers developed and in operation detect pump-off (reduced displacement) by monitoring directly or indirectly changes in rod loading during periods of reducing displacements as liquid levels fall in the annulus of the well. These units employ load sensors on the rods or on the beam of the pump system or they use current or speed sensors to detect changed loading conditions of the drive motor caused by changing rod loads when liquids fall to fill the pump barrel. When displacement changes are detected, the well is shut down for some fixed but adjustable time interval to allow some liquids to accumulate in the annulus before the pumping system is again started. There have been several documented case histories where these conventional "pump-off" controllers have resulted in significant improvement in operations. Electrical and maintenance costs have been reduced. In some cases production gains have been realized where wells were underpumped by previous manual timing methods or where excessive well down time was experienced because of excessive maintenance due to overpumping. In spite of these documented successes, there are still many more manually adjusted time controlled wells than those automatically adjusted by conventional "pump-off" controllers. Much of the reluctance to employ "pump-off" controllers to automatically adjust the cycling of the wells is due to the difficulties in the maintenance, adjustment, and care required for the conventional pump-off controllers.

The subject invention (hereafter called pump optimizer) overcomes many of the disadvantages of and has many desirable features not available in present conventional "pump-off" controllers which utilize changing rod loading to indirectly detect change in pump displacement. The pump optimizer directly measures pump liquid displacement with excellent repeatability by accurately determining the volume of liquid pumped by a few up and down strokes of the pump unit. Any change in pump displacement (due to incomplete or decreased filling of the pump barrel on the upstroke) is quickly and easily detected by the pump optimizer for operator information and action or automatic control of pump cycling whichever mode of operation is desirable.

Directly measuring pump displacement (liquid quantity pumped each stroke of the pump) has several desirable features; some of which are as follows:

(1) Liquid displacement measurement will allow the operator to observe what effect, if any, the adjustable idle-time of the pump (to allow liquid accumulation in the annulus) has on the deliverability of the reservoir. With conventional pump-off controllers, the effect of adjusting the adjustable idle-time on reservoir deliverability must be measured using conventional well test facilities which is expensive and time consuming.

(2) Liquid displacement measurement will allow the operator to observe long term and small changes in pump displacement due to worn components (plungers, barrels, balls and seats) such that remedies to replace worn components can be immediately employed when such remedies are economically feasible.

(3) Liquid displacement measurement will permit pump-up time measurement. (Pump-up time is the time interval from when the pump is again started ater being shut off for liquids to accumulate in the annulus until liquids first appear at the surface flow lines.) Changes in pump-up time are representative of changes in pump efficiency and provide an indication of the necessity or economics of pump or well repair. This measurement is not possible with conventional "pump-off" controllers.

(4) Liquid displacement measurement will allow observation or indication of change and magnitude of change of reservoir deliverability of the individual well. This is extremely important information in optimizing daily production (producing the maximum amount of oil at minimum cost each day) and in evaluating secondary or enhanced recovery efforts by correlating individual well and reservoir fluid injection rates, volumes, patterns, and pressures with that of the individual well and reservoir withdrawal rates.

(5) Liquid displacement measurement will permit automatic control of pump speed (strokes per minute) or control of both pump speed and time pumped to provide a further improvement in the performance of the lift system to increase reservoir deliverability of the individual well and decrease lift costs. Control of pump speed with conventional pump-off controllers is difficult if not impossible since the variable (pump speed) directly affects rod loading.

OBJECT AND ADVANTAGES

While present conventional "pump-off" controllers provide a means of controlling pumping time of the pump system to limit "pumped-off" conditions to reduce electrical and maintenance costs, they provide only a relative indication of reservoir deliverability. By monitoring or recording the time a well pumps over some specified time interval (24 hours) and assuming the displacement of the pump to be constant, the time which the pump operates over this specific time interval is indicative of the volume of fluids pumped. The problem associated with this means of monitoring reservoir deliverability is that pump displacement is not constant because of worn or damaged pump components or because of changes in pump volumetric efficiency due to increased restrictions to flow for any reason from the well bore to the pump barrel. As a consequence, any indicated change in reservoir deliverability of the individual well requires verification by employing well testing facilities for the actual determination of liquid volumes produced by the well. This verification procedure is time consuming and expensive; and, since the test facilities are shared in most cases, among several wells, verification of actual well output is infrequent. Infrequent verification of reduced deliverability can and does result in reduced production from the well.

Additionally, presently used "pump-off" controllers are difficult to adjust and operate by personnel normally employed to supervise the operation of rod pumping systems. Direct measurement of liquid displacement to monitor and control well production and pump performance, on the other hand, is easy to observe and understand by unskilled personnel involved in oil field production operations.

The volume and rate of liquids produced at the well head of producing oil wells has always been desirable information for the reasons discussed. This measurement has been difficult and expensive to implement because of the presence of gas in varying quantities in the fluid stream. Practically all successful efforts to measure volumes of liquids produced at the well head have required the separation of gas from the fluid stream prior to the metering of the remaining liquids. These methods of separation of fluids and metering of liquids have required liquid level controllers, pressure regulation equipment, and liquid measurement instrumentation of one type or another. These methods have been well documented in patent applications and in technical literature. These methods of liquid measurement have one or more of the following problems:

(1) They are bulky, require considerable capital expenditure, and are difficult to maintain at individual well sites.

(2) Failure modes of the valving and instrumentation can result in the restriction of flow from the well.

(3) Controllers and instrumentation result in significant pressure differential between the inlet and outlet of the separation vessel resulting in some loss of reservoir deliverability.

The subject invention provides a novel method of measuring liquids at the well head and at the same time avoids many of the problems associated with present well head liquid measurement practice:

(1) The subject invention to measure liquid in a fluid stream containing both liquids and gases is relatively small, inexpensive, and simple compared to conventional liquid measurement systems in the same environment.

(2) The subject invention to measure well head liquids will not obstruct or restrict flow of well fluids from the inlet to the outlet of the apparatus in any failure mode of the valving or instrumentation of the apparatus. This feature assures any well operator of no loss of production or resultant hazardous conditions due to failures.

(3) The subject invention to measure well head liquids requires little pressure differential to force fluids from the inlet to the outlet of the measurement apparatus. This avoids loss of reservoir delverability.

While the discussion of the subject to measure liquids with excellent repeatability in a fluid stream containing both liquids and gases is confined to applications involving the monitoring and controlling of rod pumping systems, it is obvious that the apparatus may be used in any fluid stream containing liquids and gases to monitor and control any type of lift system that may be employed to transfer fluids from the subsurface reservoir to surface facilities.

DRAWING FIGURES

FIG. 1 Schematic diagram of pump optimization system according to the preferred embodiment.

Figure 2:
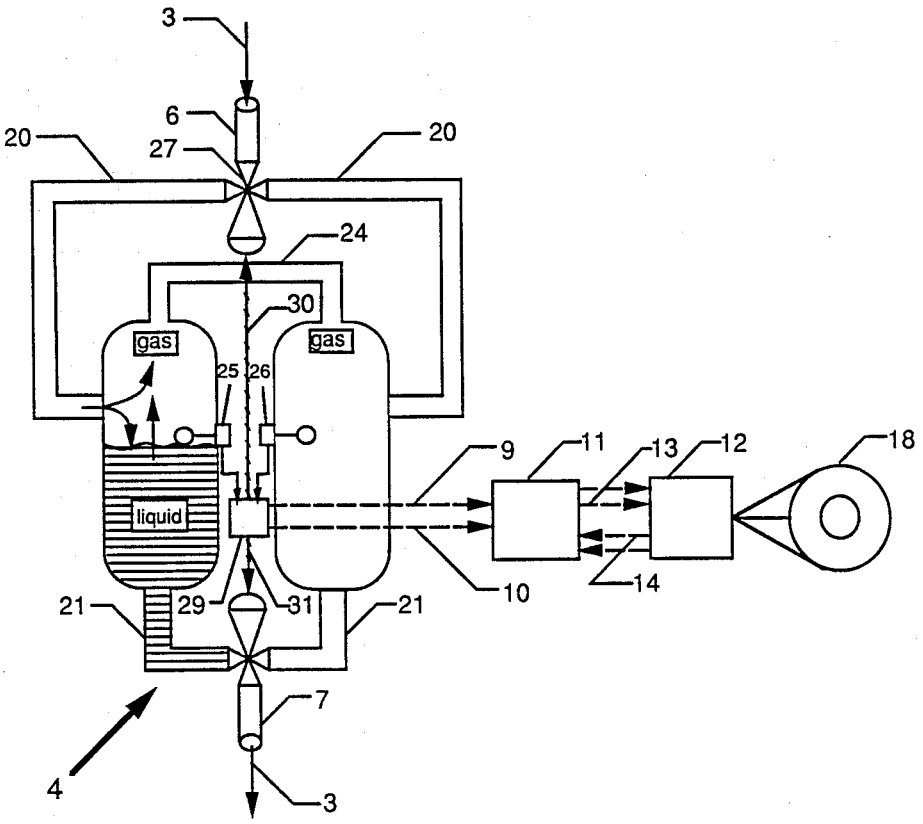

FIG. 2 Liquid measurement apparatus 4 diagram.

Figure 3:
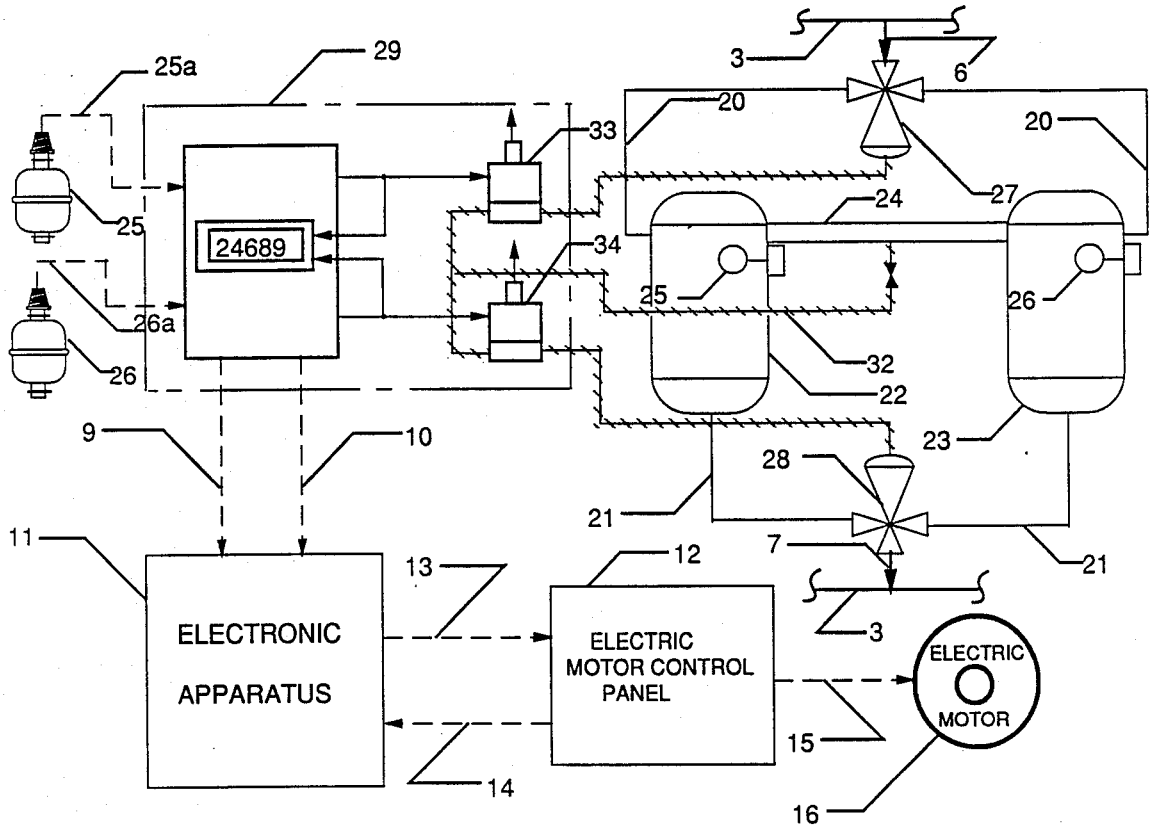

FIG. 3 Block and schematic diagram illustrating the function and components comprising controller 29.

Figure 4:
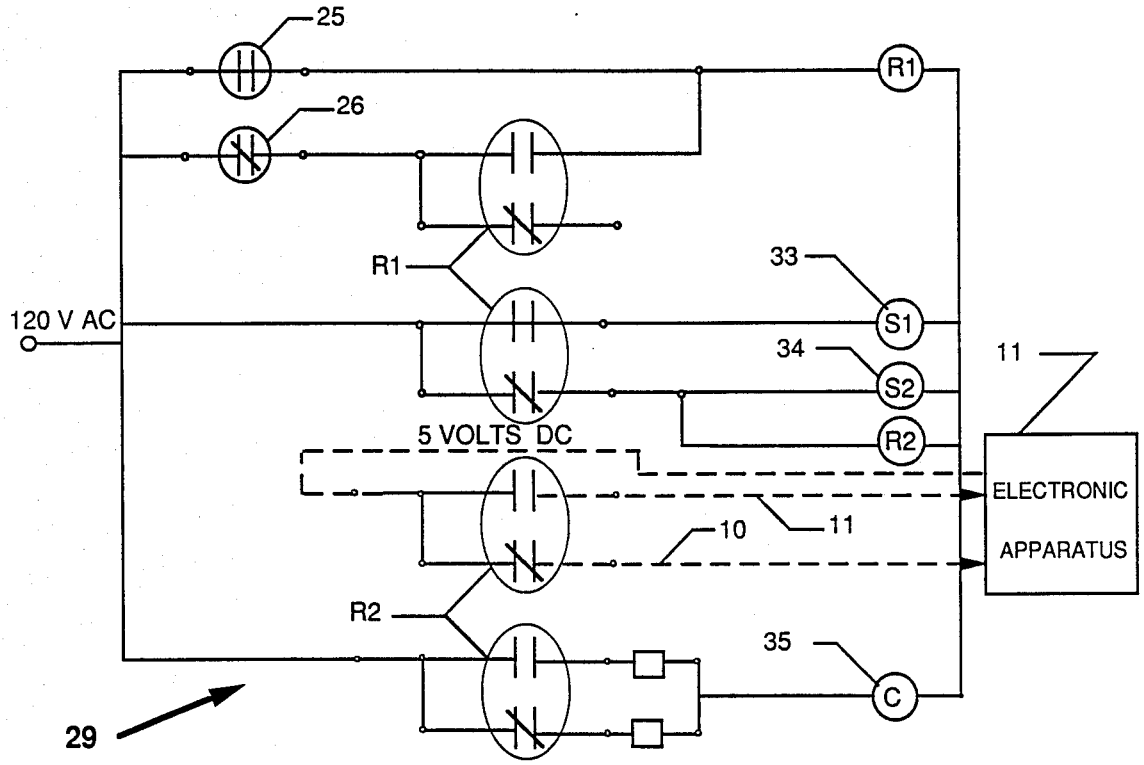

FIG. 4 Electrical schematic diagram of controller 29.

Figure 5:
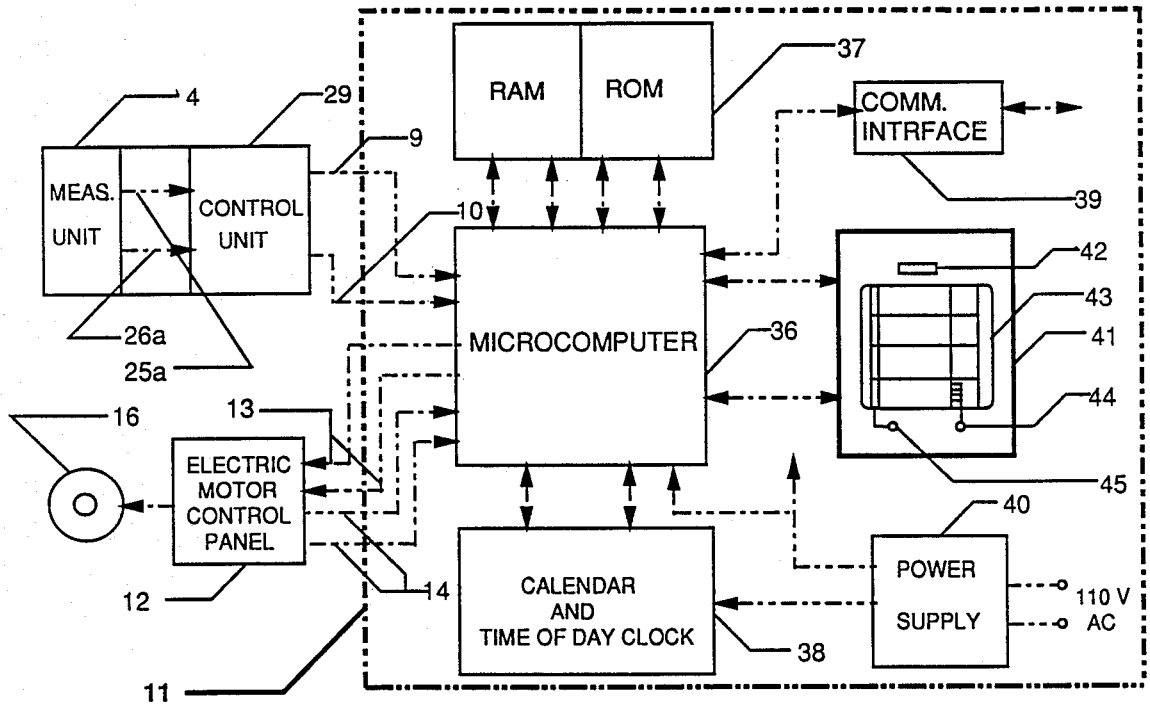

FIG. 5 Block diagram of electronic apparatus 11.

Figure 6:
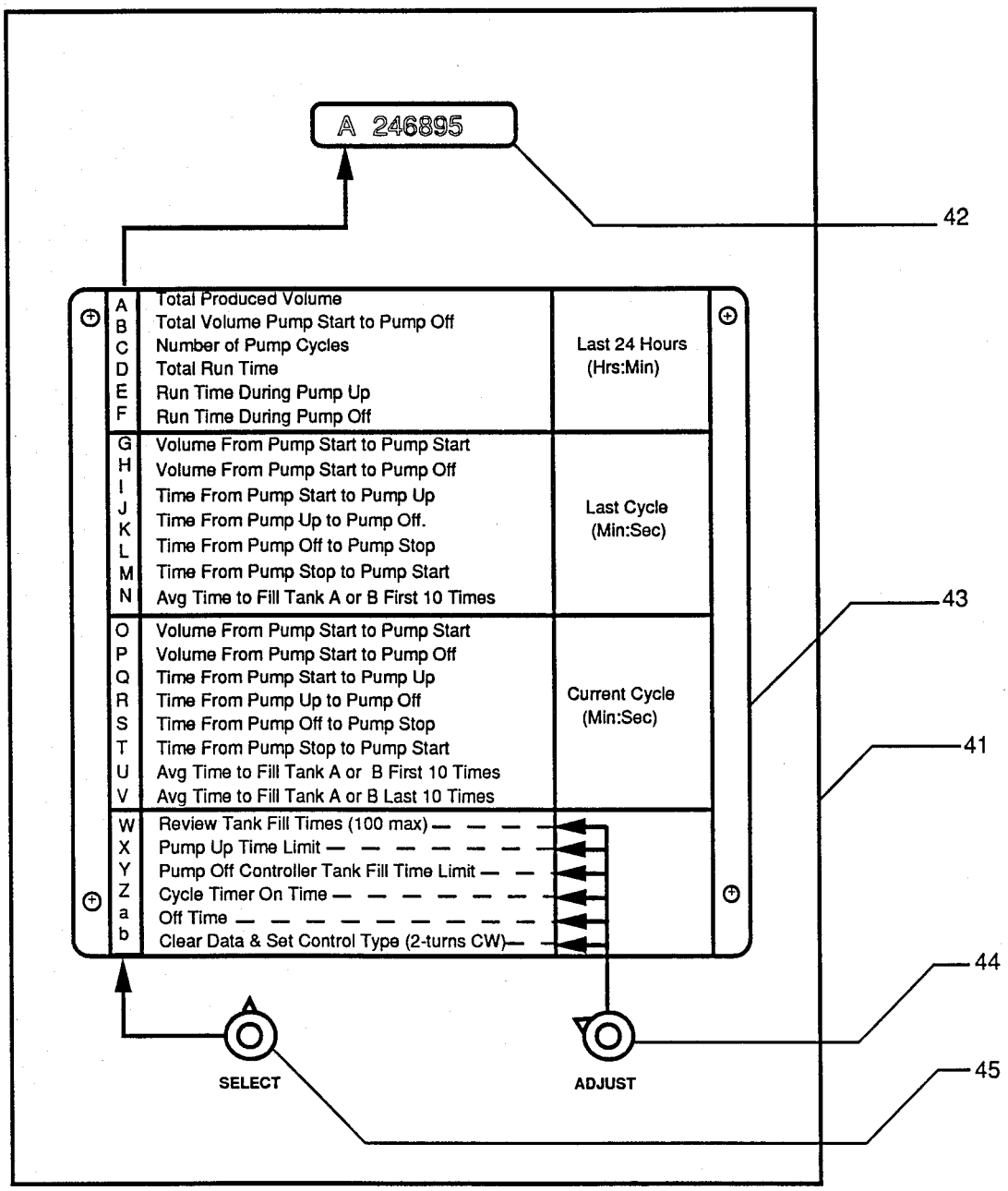

FIG. 6 Front panel of electronic apparatus 11.

Figure 7:
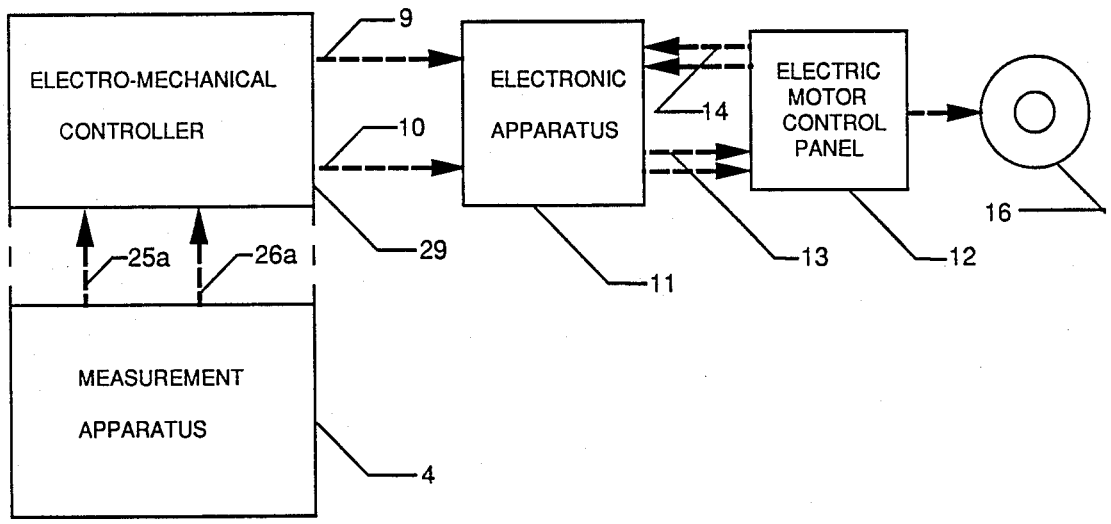

FIG. 7 Block diagram of Pump Optimization System according to the preferred embodiment.

Figure 8:
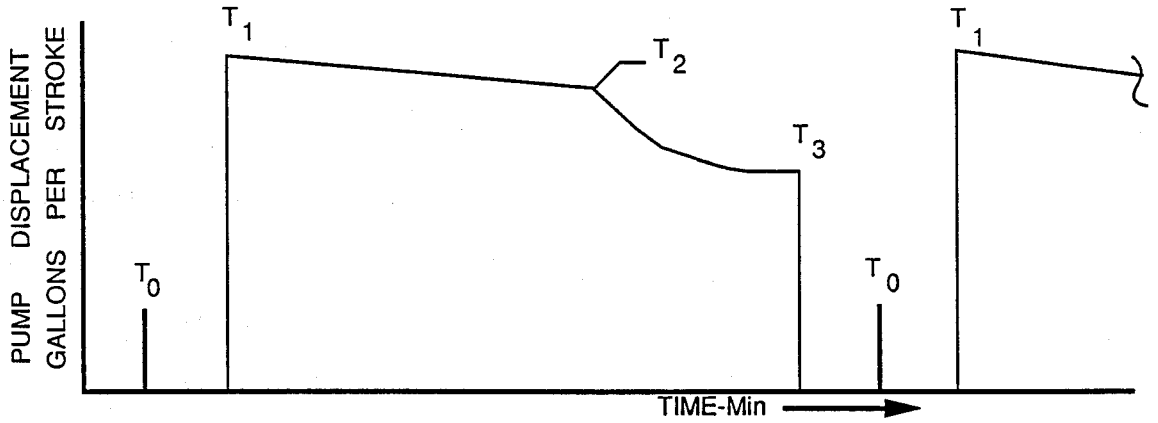

FIG. 8 Illustration of a typical pumping cycle where the time the well is being pumped is controlled by a percentage timer.

Figure 9:
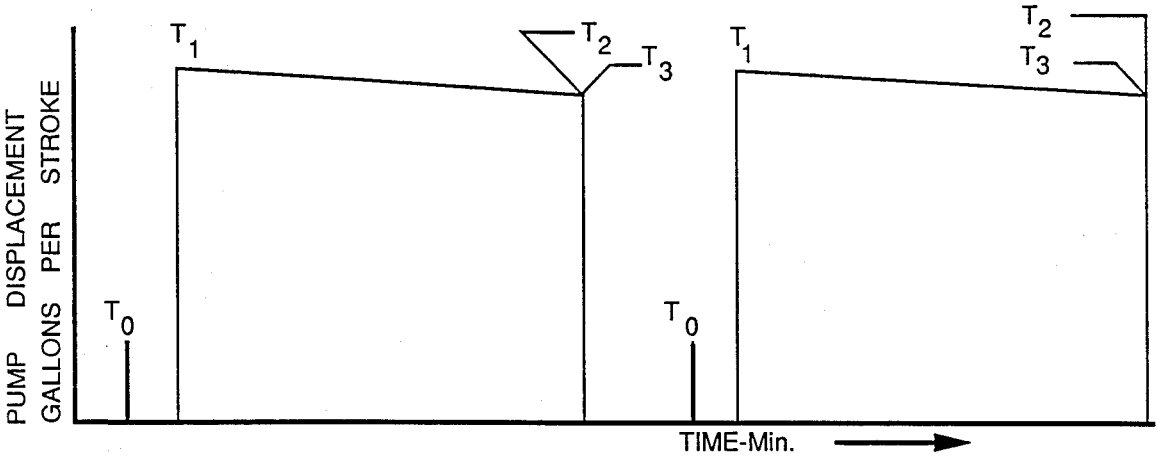

FIG. 9 Illustration of a typical pumping cycle where the time the well is pumped is controlled by the Pump Optimization System.

Figure 10:
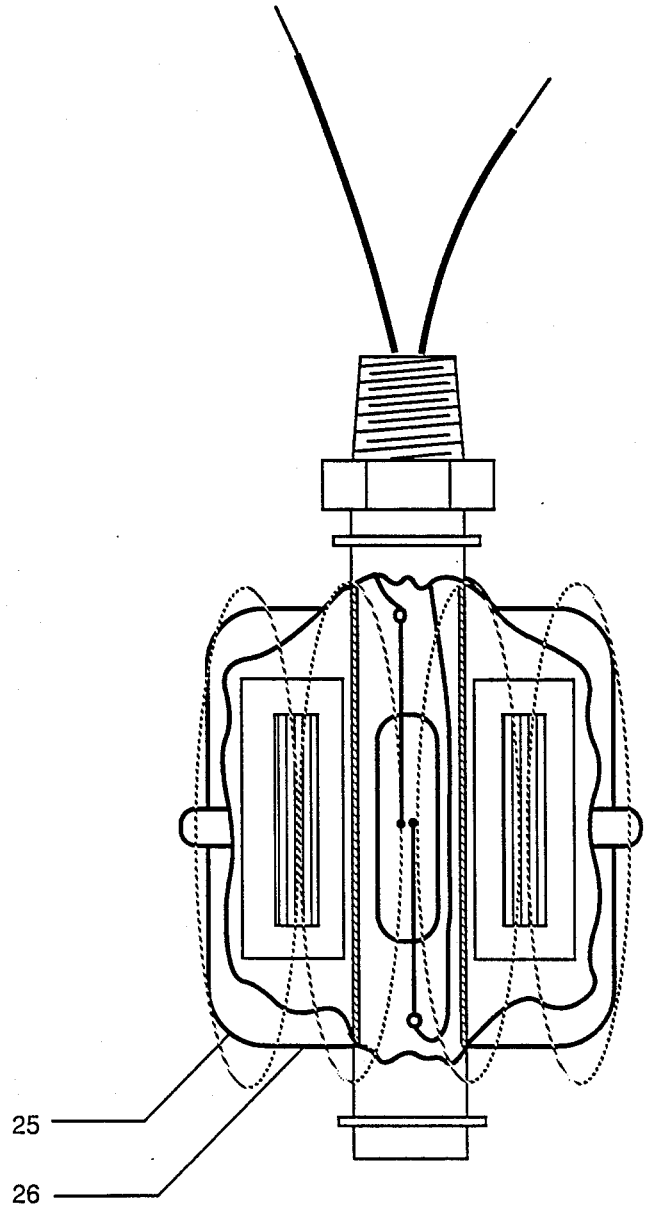

FIG. 10 Schematic illustration of float switch 25 and 26 construction according to the preferred embodiment.

Figure 11:
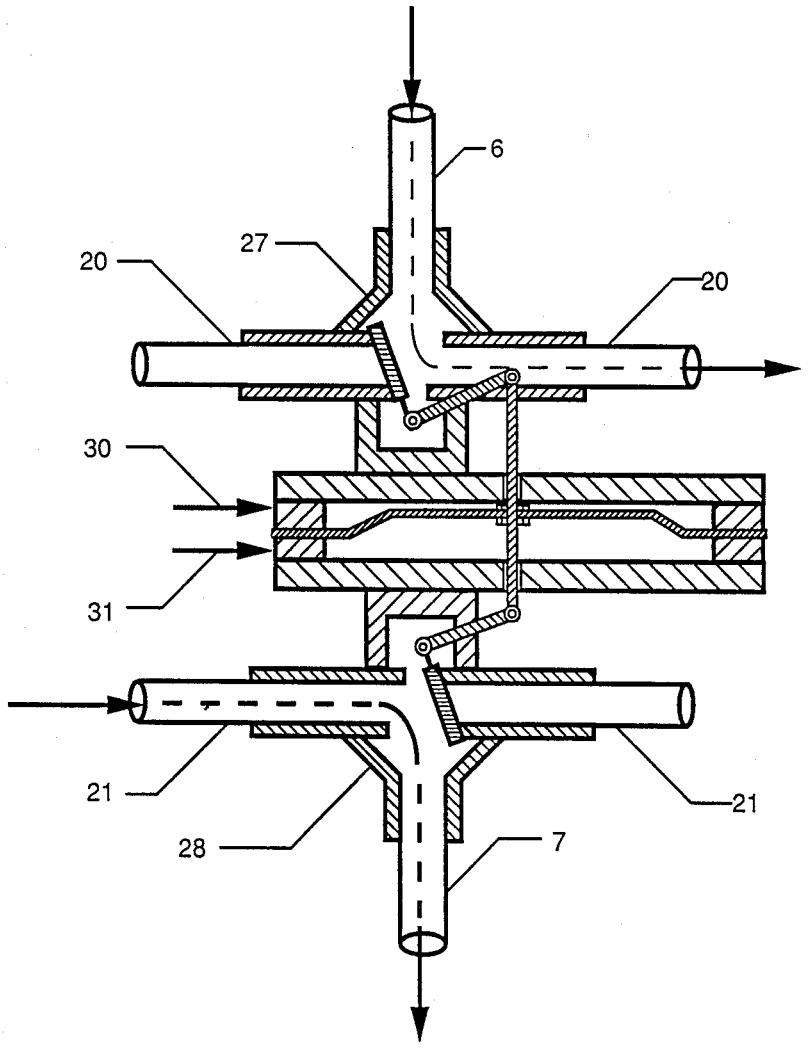

FIG. 11 Illustration of diverter valves 27 and 28 operated by a single diaphragm operator.

Figure 12:
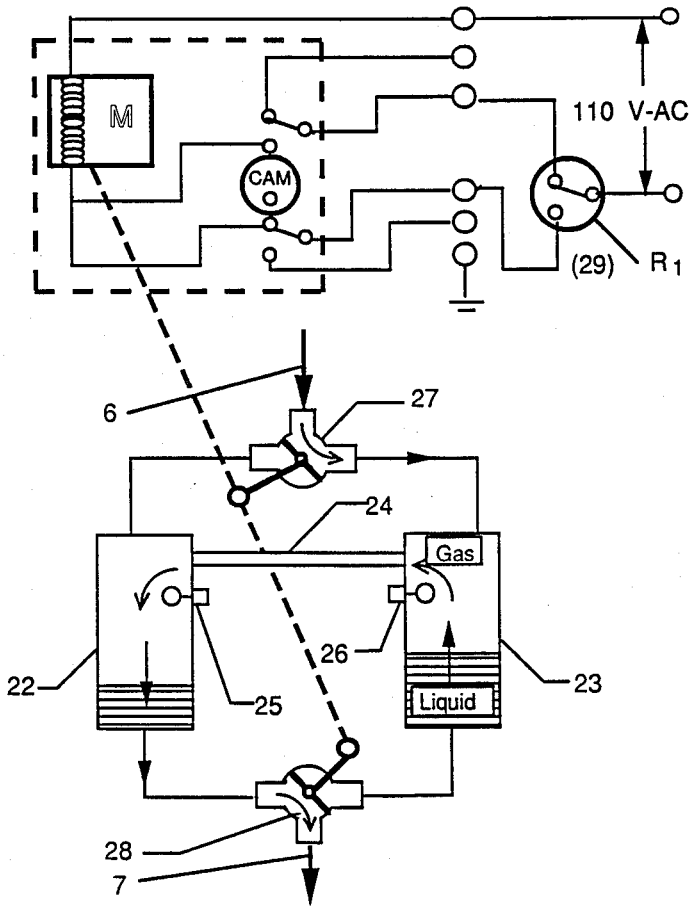

FIG. 12 illustration of electric motor driven diverter mechanism 27 and 28 with associated electrical schematic for controller 29

Figure 13:
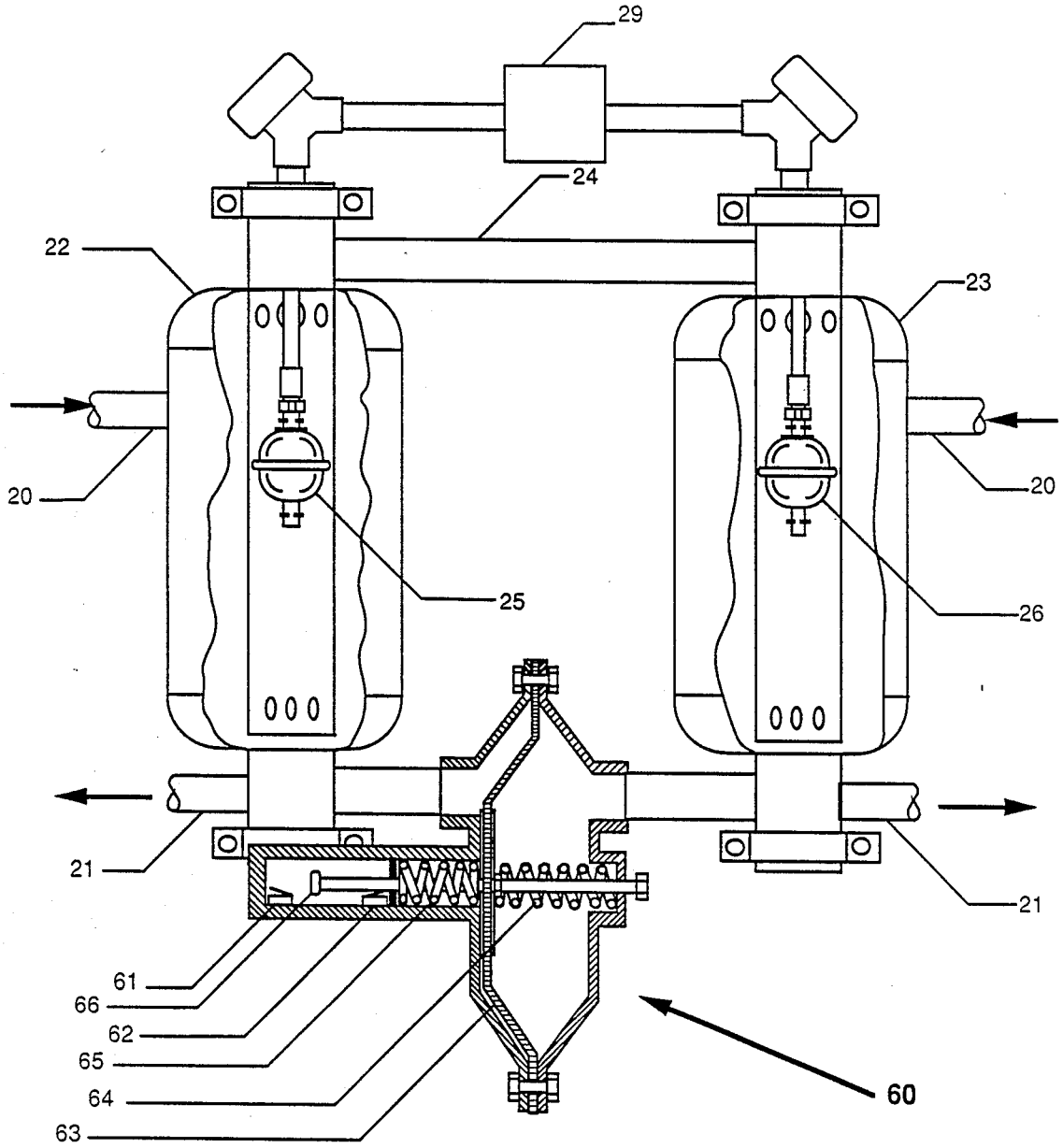

FIG. 13 illustration of a hydrostatic head switch that may be employed in lieu of float switches 25 and 26 illustrated in FIG. 10.

Figure 14:
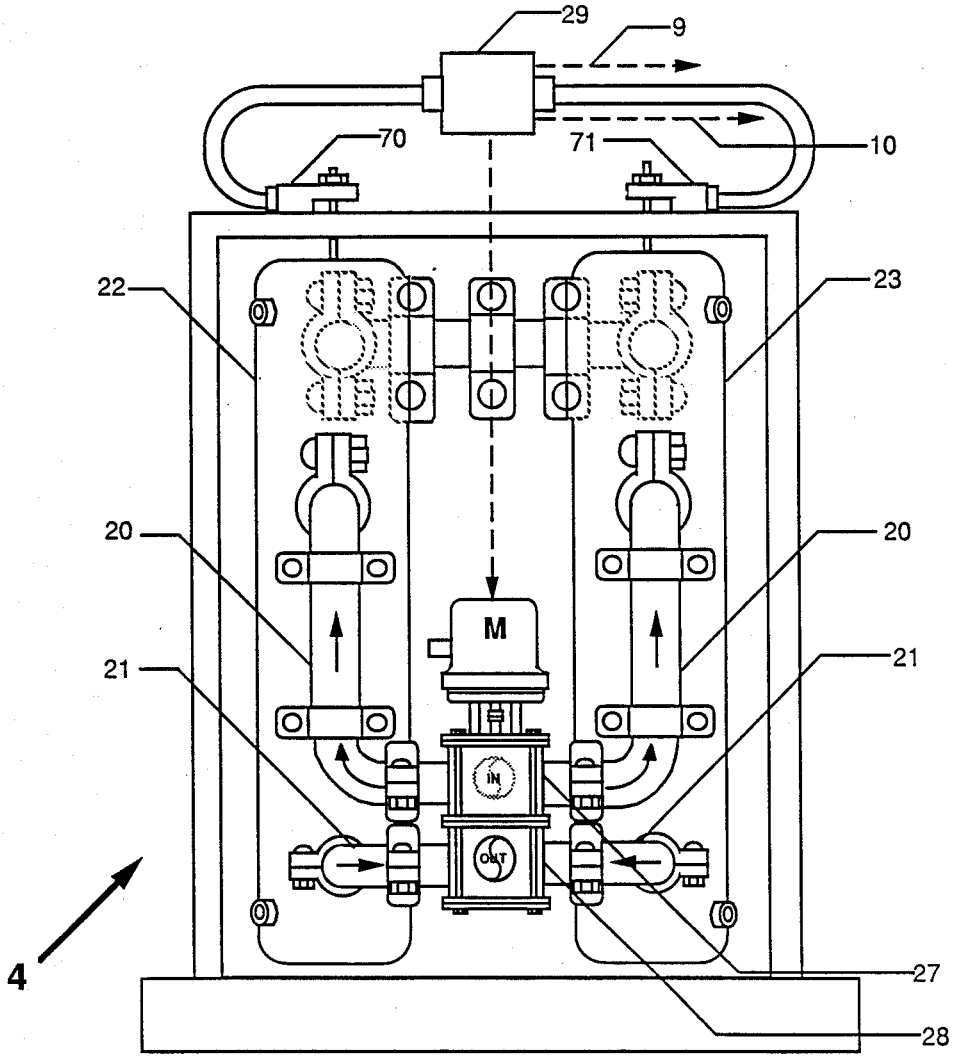

FIG. 14 Illustration of load switches that may be used in lieu of float switches 25 and 26 illustrated in FIG. 10.

Figure 15:
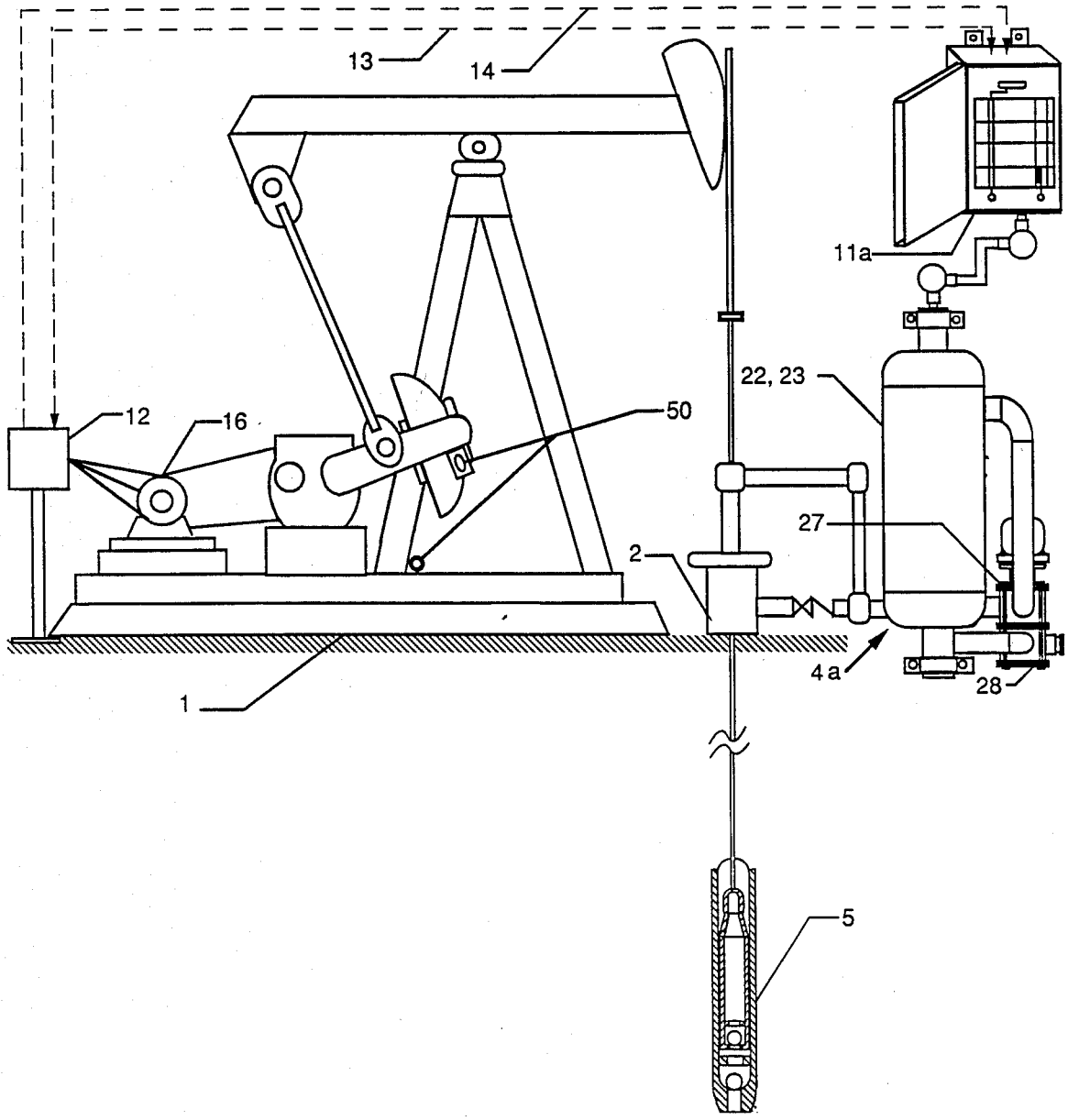

FIG. 15 Illustration of Pump Optimization System with an alternate embodiment where means for sensing liquid quantities in tanks 22 and 23 provides an analog signal to electronic apparatus 11*a* which also directly controls diverter mechanisms 27 and 28 eliminating controller 29.

Figure 16:
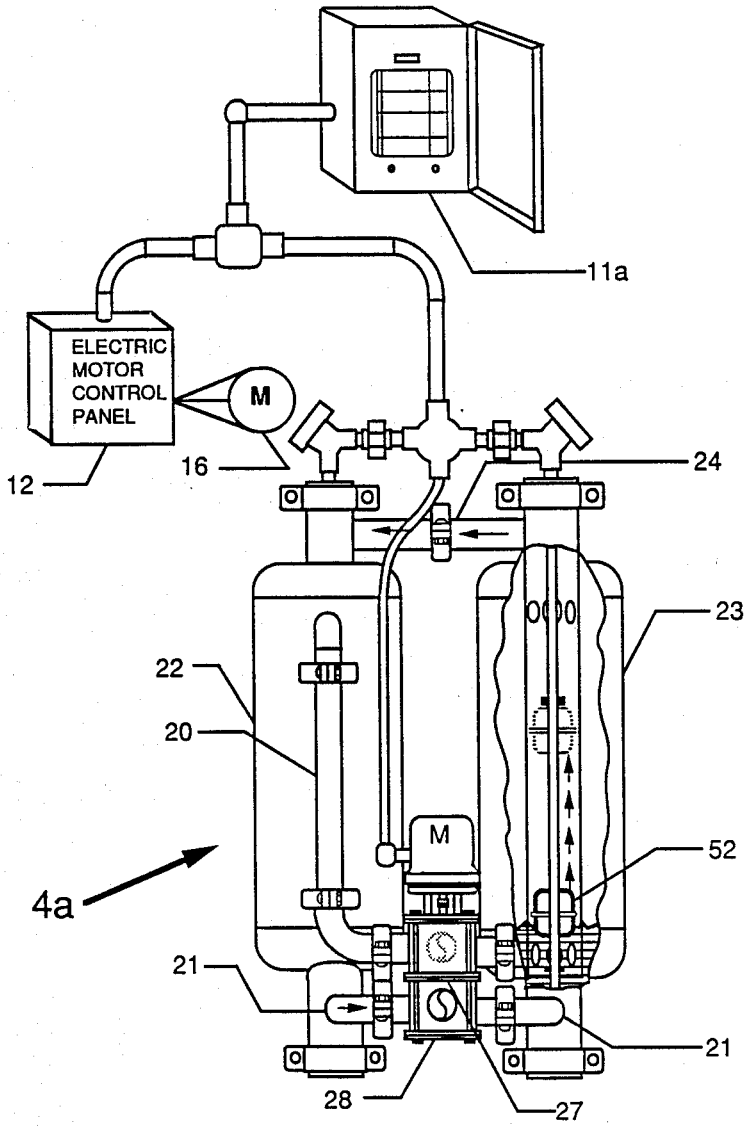

FIG. 16 Illustration of liquid measurement apparatus 4*a* of the alternate embodiment with a level transducer providing the analog signal to electronic apparatus 11*a*.

Figure 17:
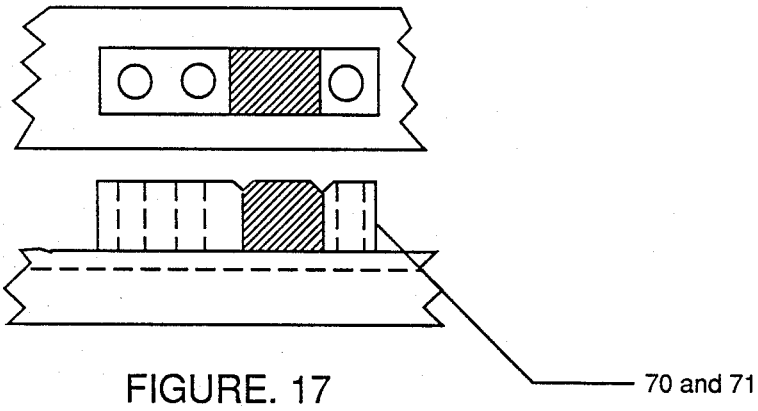

FIG. 17 Illustration of load sensing means to provide analog signal to electronic apparatus 11*a*.

Figure 18:
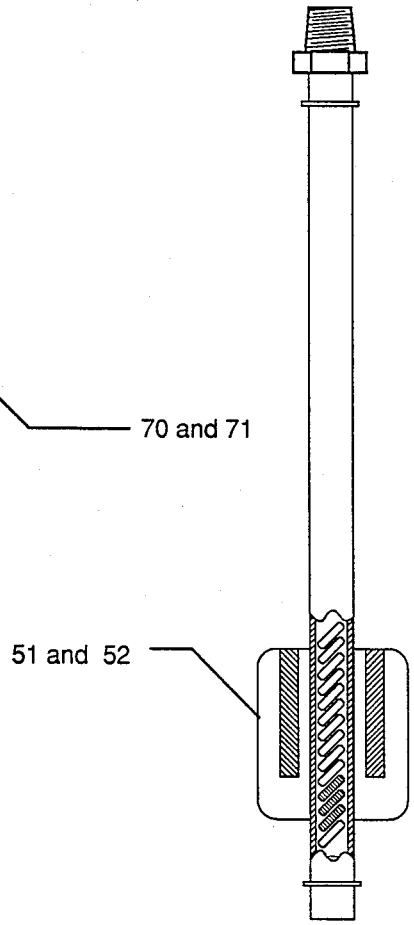

FIG. 18 Illustration of level sensing means to provide an analog signal to electronic apparatus 11*a*.

Figure 19:
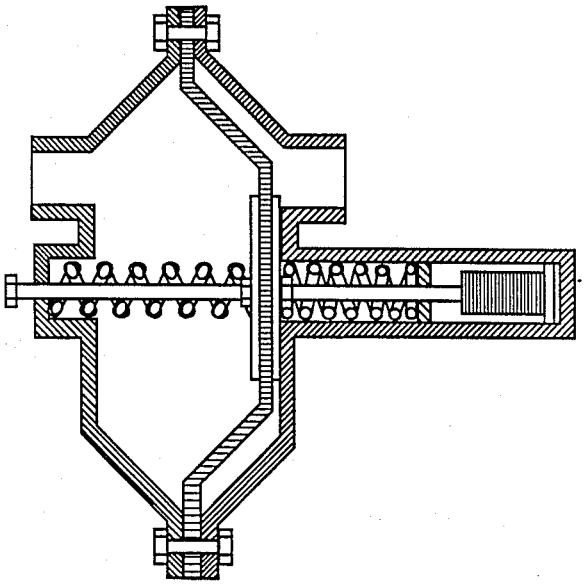

FIG. 19 Illustration of hydrostatic sensing means to provide an analog signal to electronic apparatus 11*a*.

Figure 20:
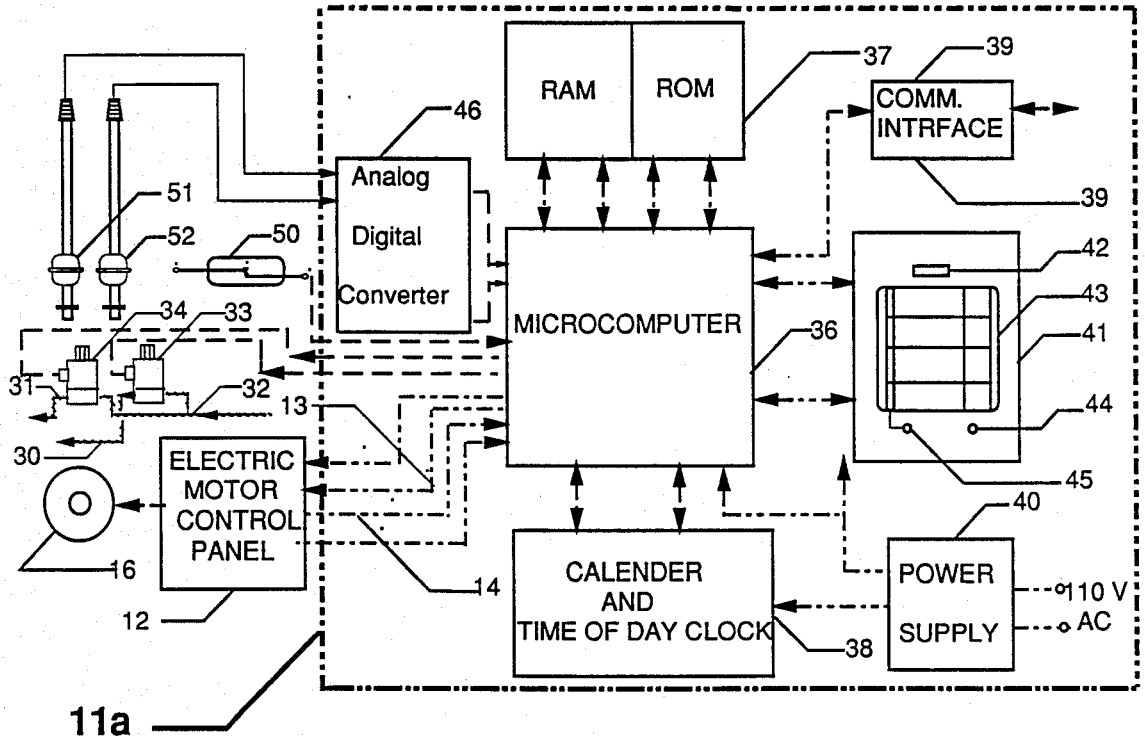

FIG. 20 Block diagram of electronic apparatus 11*a* according to the alternate embodiment.

Figure 21:
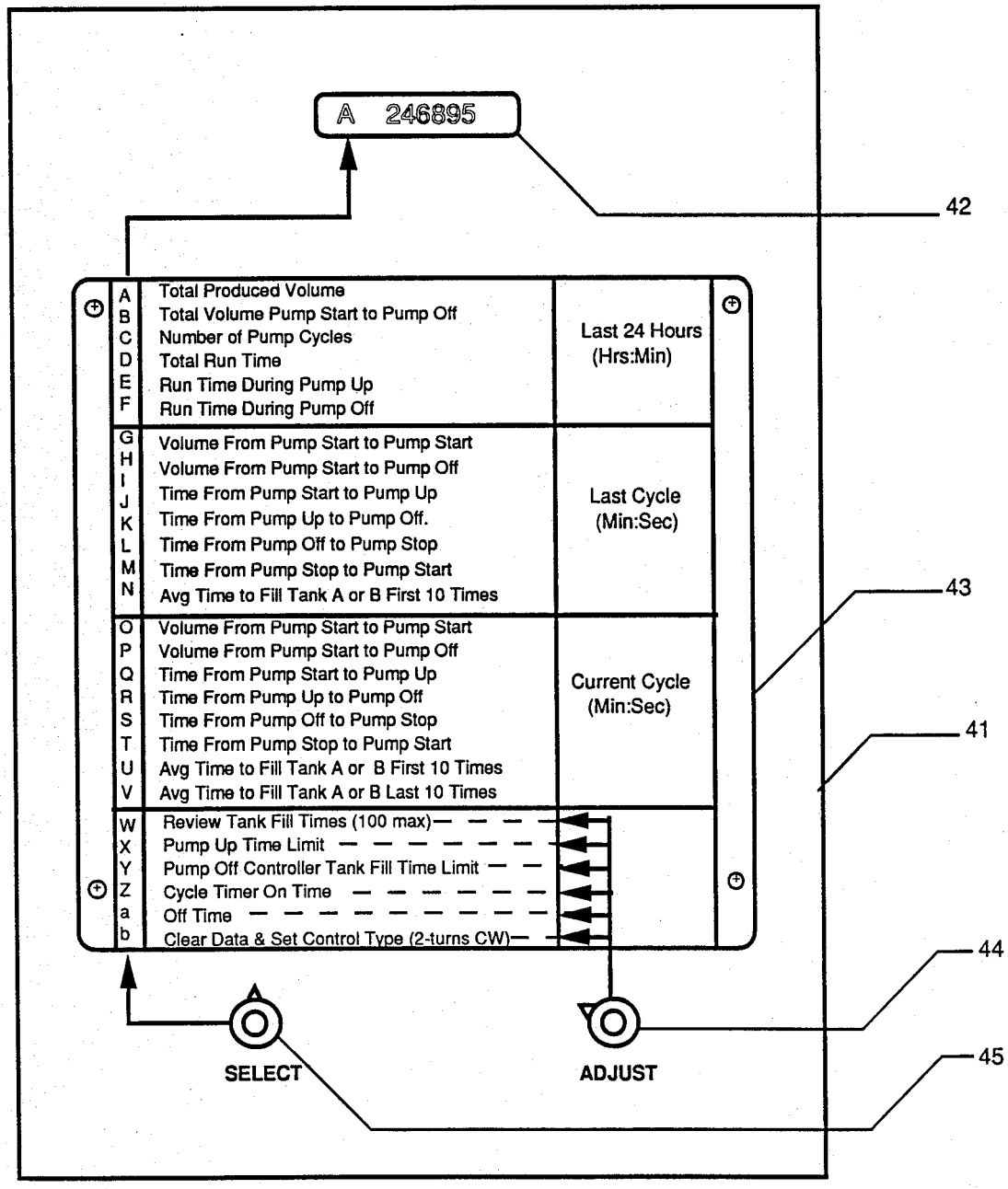

FIG. 21 Illustration of front panel of electronic apparatus 11*a* according to the alternate embodiment.

Figure 22:
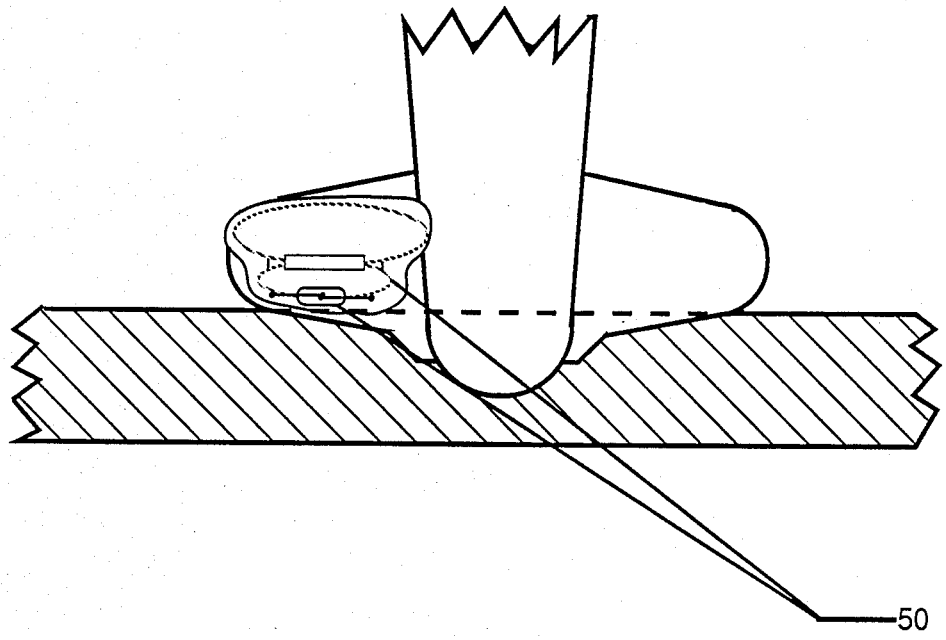

FIG. 22 Illustration of pump stroke sensing means to count number of pump strokes and to determine the speed of the pump system.

DESCRIPTION OF THE PUMP OPTIMIZATION SYSTEM

Referring to FIG. 1, which illustrates the installation of a pump optimization system, fluids are pumped from an underground reservoir by a rod pumping unit 1 through well head 2 and flowline 3 and a liquid measurement apparatus 4 which is used to determine the quantity of liquids pumped by the reciprocating subsurface pump 5. Fluids consisting of liquids and gas, are pumped through inlet line 6 of the liquid measurement apparatus 4 and are discharged through discharge line 7 to flow line 3. The liquid measurement apparatus 4 provides electrical signals 9 and 10, representative of a quantity of liquid pumped, to an electronic apparatus 11, a means to determine the actual liquid displacement of the subsurface pump 5, to record production data, and to detect specified liquid displacement deviations of pump 5.

Electronic apparatus 11 is electrically connected by control signals 14 and indicating status signals 13 to the electric motor controller 12 which turns electric motor 16 on and off to control the pumping time of the pumping system in response to control signals from a manually adjusted internal interval timer when the pump optimization system is used in a monitor only mode or from control signals 14 from electronic apparatus 11 in response to specified changes in pump liquid displacement when the pump optimization system is used in a monitor and control mode. When the pump optimization system is used in a monitor only mode, electronic apparatus 11 displays and records pump liquid displacement and liquid quantities pumped over selected time periods, and during the on/off cycling of the pump system controlled by the interval timer contained within the electric motor controller 12. In the monitor only mode, electronic apparatus 11 provides no on/off control signals 14 to electric motor controller 12. In the monitor only mode, the electric motor controller 12 provides indicating status signals 13 to electronic apparatus 11 to indicate whether the pump is in a running or stopped condition both of which are controlled by the manually adjustable interval timer contained in electric motor controller 12.

In the monitor and control mode, electronic apparatus 11 provides the contrl signals 14 in response to specified deviations in pump 5 liquid displacement to the electric motor controller 12 which in turn controls the starting and stopping of electric motor 16.

FIG. 2 shows a liquid measurement apparatus 4 with electronic apparatus 11, a means to determine actual liquid subsurface displacement of pump 5, to monitor only or monitor and control pump system performance according to the preferred embodiment. The measurement apparatus 4 comprises two tanks 22 and 23 each of which has a fluid inlet line 20 and a fluid discharge line 21, and a conduit 24 connecting the two tanks 22 and 23 near the top through which gases contained in the pumped fluids may pass in either direction—from tank 22 to tank 23 or from tank 23 to tank 22. The two inlet lines 20 of tank 22 and 23 are connected to a common inlet line 6 through a diverter valve 27 which alternately diverts pumped fluids into either tank 22 or tank 23. The two discharge lines 21 of tanks 22 and 23 are connected to a common discharge line 7 through a diverter valve 28 which alternately discharges fluids from either tank 22 or tank 23 to the common discharge line 7.

Both tanks 22 and 23 contain float switches 25 and 26 to provide an electrical signal to controller 29 when tanks 22 or 23 accumulate liquids to the level at which float switches 25 and 26 are positioned. Controller 29, illustrated in FIGS. 3 and 4, is employed to control the position of diverter valves 27 and 28 on the inlet and discharge lines 6 and 7 of tanks 22 and 23 when receiving electrical signals from float switches 25 and 26. Controller 29 also records each signal 9 and 10 from float switches 25 and 26 on an electromechanical counter. The accumulation of these signals, 9 and 10, on the electromechanical counter is representative of the volume of liquids passing through the two tanks 22 and 23. The two tanks, 22 and 23, with diverter valves, 27 and 28, float switches, 25 and 26, and controller 29 comprises the basic elements required for the measurement of the liquid volumes contained in fluids containing both liquids and gases and flowing through tanks 22 and 23 from inlet line 6 to discharge line 7. The means to determine actual subsurface pump liquid displacement is contained in electronic apparatus 11 which is a microprocessor based monitoring and control unit as illustrated in FIGS. 5, 6 and 7. Electronic apparatus 11 is electrically connected to controller 29 to receive signals 9 and 10 generated by float switches 25 and 26 of tanks 22 and 23. Each signal 9 and 10, received by electronics apparatus 11, is representative of the quantity of liquid accumulated alternately in tanks 22 and 23 and pumped by the rod pumping system illustrated in FIG. 1.

FIG. 3 and FIG. 4 illustrate the mechanics of controller 29 of the preferred embodiment of the present invention. Controller 29, which includes 3 way electrically operated pneumatic control valves 33 and 34, controls the position of the pneumatically operated diverting valves 27 and 28 which in turn control the accumulation and discharge of liquids in tanks 22 and 23 as fluids flowing or being pumped from the oil well pass from inlet line 6 to discharge line 7 of the measurement apparatus illustrated in FIG. 2. Controller 29 also includes an electromechanical counter to record the number of times liquids accumulating in tanks 22 and 23 actuate float switches 25 and 26. Controller 29 also provides electrical signals 9 and 10, representative of the quantity of liquids being pumped from the well, to electronic apparatus 11 for additional processing and analysis.

FIGS. 5, 6 and 7 illustrate the logic and operation of electronic apparatus 11 according to the preferred embodiment of the present invention. Apparatus 11 is used to determine the displacement of pump 5 (FIG. 1) to monitor only, or to monitor and control the performance of the pumping system. Apparatus 11 is also used to record production data in a format that may be used by oil field personnel to monitor and control the performance of the reservoir as described later.

FIG. 10 illustrates the construction of float switches 25 and 26 placed in tanks 22 and 23 of the preferred embodiment. These float switches consist of a float, a magnet contained in the float, and a hermetically sealed reed switch which is activated as the float rises or falls in response to the rise and fall of liquids in tanks 22 and 23. These reed switches may be made to operate in a normally open or normally closed state dependent on the position of the magnet when the float is suspended in air or gas. These switches may be changed from normally open to normally closed or vice versa by removing the float from the stem and reversing the float. In the logic diagram (FIG. 4) float switch 25 is normally open and float switch 26 is normally closed.

FIG. 11 illustrates the construction of diverter mechanisms 27 and 28 operated by the motion of a pneumatically driven diaphragm. The position of these diverter mechanisms, 27 and 28, is operated by a single diaphragm operator, the position of which is determined by pneumatic signals 30 and 31 which in turn are controlled by electrically actuated solenoids 33 and 34, only one of which is energized at any one time during the operation of measurement apparatus 4.

Although the preferred embodiment of the present invention consists of float switches 25 and 26 and pneumatically positioned diverter mechanisms, 27 and 28, it is obvious to anyone that other sensing means to sense a quantity of liquids accumulating in tanks 22 and 23 are possible. Two of these possible sensing means are illustrated in FIG. 13 (a hydrostatic head switch) and FIG. 14 (a load switch).

An electric motor actuated diverter mechanism may also be employed to alternately switch the fill and discharge lines, 20 and 21, of tanks 22 and 23 such that when tank 22 is accumulating liquids, tank 23 is discharging fluids and vice versa. Such an electric motor actuated diverter mechanism is illustrated in FIG. 12.

FIGS. 15, 16, 17, 18, 19, 20, 21 and 22 illustrate an alternate embodiment of the subject invention to measure liquids in a fluid stream containing both liquids and gases and to analyze measured data to monitor and/or control the performance of a rod pumping system required to pump fluids from a subsurface oil reservoir.

The primary difference between this alternate embodiment and the preferred embodiment is in the sensing means used to detect liquids accumulating in tanks 22 and 23 of measurement apparatus **4*a* FIG. 16. These sensing means provide an analog signal proportional to the quantity of liquids present in either tanks 22 and 23, one of which is accumulating liquids while the other is discharging fluids (liquids and gases). These sensing means (load sensors, level sensors, or hydrostatic head sensor) are illustrated in FIGS. 17, 18 and 19 respectively. Electronics apparatus 11*a* is likewise modified by the addition of an analog digital converter 46 (FIG. 20) to accept the analog signals from any of the sensing means. In the alternate embodiment, electronic apparatus 11*a* also controls the switching of diverter mechanisms 27 and 28 (FIG. 16) eliminating controller 29** of the preferred embodiment.

As a further addition to the alternate embodiment, a stroke sensing means, illustrated in FIG. 22 and consisting in this instance of a permanent magnet and reed switch, is employed to count the number of strokes of the reciprocating subsurface pump and to determine the speed of the pumping system. The permanent magnet is mounted on the counter weight of crank arm of the pumping unit. Each time the magnet passes the reed switch (each revolution of the crank arm), the reed switch is actuated to provide an indication of a stroke of the pump. The time between switch actuations is proportional to the speed of the pumping system.

These switch closures are used to count the number of strokes of the pumping system over specified time intervals to relate the quantity of liquids measured to the number of strokes required to pump the measured quantity. These data (liquids displaced each stroke and the speed of the pump) can then be used to control the speed of the pump to match pump capacity to the liquid delivery capability of the reservoir to provide an added improvement in pump performance by minimizing dynamic horsepower requirements.

OPERATION OF THE PUMP OPTIMIZATION SYSTEM

The subject invention consists of two principal concepts:

(1) Measuring with consistent repeatability, the quantity of liquids in a fluid stream containing both liquids and gases and (2) The analysis of this quantitative liquid measurement to determine actual liquids displaced each stroke by a reciprocating subsurface pump required to move liquids from the subsurface reservoir to surface facilities.

The analysis of the quantitative liquid measurement is employed to detect changes in the quantities of liquids displaced each stroke by the pump over short periods to control either the speed of the pump or the time the well is pumped or both (speed and time) to reduce power consumed and to reduce maintenance to mechanical components by regulating the pumping capacity to equal the capacity of the reservoir to deliver liquids to the well bore. The analysis of the quantitative measurement is also employed over longer pumping time periods to detect efficiency degradation of the pumping system to enable more timely remedial effort to restore pumping performance enhancing return on invested capital. Liquid measurement data and corresponding liquids displaced by each stroke of the pump may, in addition, be utilized over short and long time intervals to detect changes in the ability of the reservoir to deliver liquids to the well bore enabling timely remedial efforts to restore reservoir producibility.

In summary, the subject invention permits the operator to measure and control pumping efficiencies and at the same time measure and maintain the flow of fluids from the reservoir to the well bore. This allows any operator of rod pumping systems to produce more well fluids daily at less cost and ultimately to recover more of the original oil in place within the reservoir.

FIG. 1 illustrates a typical rod pumped oil well on which a pump optimization system has been installed. In this illustration, the pump 5 is being driven by an electric motor 16 which is controlled by a control panel 12 usually used to control the time the well is pumped by turning on and off the electric motor 16. The pumping system, may, on occasion, be operated continuously 24 hours a day. Continuous operation of the pump is the practice when reservoir capacity is greater than the capacity of the pump to pump liquids delivered to the well bore.

In the United States, the majority of rod pumps are "oversized". In this case, it is the normal practice to use a percentage timer to adjust the time a well pumps to match the pump capacity to reservoir capacity to achieve a more efficient operation. There are other means by which pump capacities may be altered some of which are as follows:

(1) Subsurface pump diameters may be changed.

(2) The speed of the pump (strokes per minute) may be altered.

(3) The length of the stroke may be increased or decreased.

(4) Designs may be changed—size/type of rods, depth of pump, etc.

Pump diameters, pump speed, length of stroke, and design changes are not easily and inexpensively accomplished. As a consequence, short term adaptations of pump capacities are implemented by adjusting the percentage of time a well is pumped over selected time intervals. Example: (some percentage of time each 30 minutes).

Keeping percentage timers properly adjusted is not an easy task since both the capacity of the pump and the deliverability of the reservoir are continually changing. As a result, wells are generally "overpumped" using excessive electrical power and causing increased maintenance. But, on occasion wells are "underpumped" with a resultant loss in daily production.

The pump optimization system provides a means to measure and control efficiency of the pump and at the same time measure the capacity of the reservoir to deliver fluids to the well bore.

FIG. 2 illustrates the mechanics of liquid measurement apparatus 4 used to measure the quantity of liquids pumped by a subsurface reciprocating pump 5 illustrated in FIG. 1. In this illustration, liquids passed by the subsurface pump 5 are pumped to the surface well head 2 and through flow line 3. The liquids pumped by pump 5 and free gases produced up the annular space between the tubing and casing enter the measurement apparatus 4 (FIG. 2) from flow line 3 through inlet line 6. As these fluids flow through inlet line 6, they are routed by diverter mechanism 27 through inlet lines 20 to tank 23 or tank 23. Both liquids and gases exit tank 22 and 23 through outlet lines 21 through diverter mechanism 28 which routes the fluids from either tank 22 or 23 to discharge line 7 back into flow line 3 where fluids (liquids and gases) are then transported to well production processing facilities (separators, treaters, and storage tanks) usually located some distance from the pumping well. The measurement apparatus 4, in effect, acts as an enlarged part of flowline 3 where fluids flowing and pumping from the well enter tank 22 or 23 and are continuously discharged from the opposite tank. For example: if fluids enter tank 22, fluids are being discharged from tank 23. Since flow from inlet line 6 to discharge line 7 is continuously and fully open, there is little restriction to flow through measurement apparatus 4. The only restriction is that required to force fluids through the piping and diverter mechanisms 27 and 28. This unimpeded flow of fluids from the well to the surface production processing facilities is an important feature of measurement apparatus 4 since any increased pressure imposed at well head 2 on the reservoir will restrict the flow of fluids to the well bore. In addition, since diverter mechanism 27 and 28 illustrated in FIGS. 11 and 12 are constructed in such a manner that the flow of fluids from inlet line 6 to discharge line 7 is always fully open in any failure mode, the chance of diverter mechanisms 27 and 28 interrupting or restricting the flow of fluids through measurement apparatus 4 is eliminated.

As fluids (liquids and gases) are pumped and flow through measurement apparatus 4, they enter tank 22 or 23 through diverter mechanism 27 the position of which is controlled by controller 29. For descriptive purposes assume that controller 29 has positioned diverter mechanism 27 such that fluids enter tank 22. At the same time, controller 29 will have positioned diverter mechanism 28 such that fluids will be discharged from tank 23 (the tank opposite that in which fluids are entering). As fluids enter tank 22, any liquids (flowing or being pumped) being heavier then gas will begin to accumulate in tank 22. Any gases, being lighter than the accumulating liquids, will rise to the top of tank 22, pass through connecting conduit 24 to tank 23 and be discharged from tank 23 through outlet line 21, through diverter mechanism 28, through discharge line 7, to flow line 3. Any liquids that may have accumulated in tank 23 from a previous liquid accumulation cycle will first be discharged to flow line 3 before any gases passing from tank 22 to tank 23 through connecting conduit 24 can be discharged from tank 23 to flow line 3. Should the well produce only very small volumes of gas, the liquids accumulating in tank 22 will displace gas present in tank 22 and force this gas from tank 22 to tank 23 through conduit 24 to force any previously accumulated liquids in tank 23 through outlet line 21 of tank 23 through diverter mechanism 28 to discharge line 7 to flowline 3. This feature allows measurement apparatus 4 to operate with very small volumes of gas present in the fluids produced from the reservoir. In general during the latter stages of depletion of a water flood recovery program there is a very small volume of gas in solution or entrained in the produced fluids since most of the produced fluids pumped by the well is water. As liquids accumulate in tank 22, the level of these accumulating liquids will, in time, reach the level at which float switch 25 (illustrated in FIG. 10) is positioned. At this time, an electrical switch is actuated (closes)—see FIGS. 3 and 4. When this switch 25 closes, relay R1 of controller 29 is energized which energizes solenoid 33 and deenergizes solenoid 34. The action of float switch 25, relay R1, and solenoids 33 and 34 causes pneumatic signals 30 and 31 to be reversed to cause diverter mechanism 27 which was diverting incoming fluids to tank 22 to now divert these incoming fluids to tank 23 and fluids which were being discharged from tank 23 through diverter mechanism 28 to now being discharged from tank 22. The liquids that had accumulated in tank 22 to actuate float switch 25 will first be discharged from tank 22 before any free gases may be discharged from this tank. Now, since fluids are entering tank 23 and being discharged from tank 22 liquids will begin to accumulate in tank 23. When these accumulating liquids rise to a level in tank 23 where float switch 26 (illustrated in FIG. 10) is located, float switch 26 (normally closed) will open. Opening this float switch will deenergize relay R1 (controller 29, FIG. 4) which deenergizes solenoid 33 and energizes solenoid 34 again reversing pneumatic signals 30 and 31 causing diverter mechanisms 27 and 28 to revert to their original positions with fluids entering tank 22 and being discharged from tank 23. Each time float switch 25 is actuated (closes) or float switch 26 is actuated (opens), relay R1 is energized and deenergized accordingly. Relay R1 will simultaneously deenergize and energize relay R2 of controller 29 causing an electromechanical counter 35 to increment one count each time either float switch, 25 or 26, is actuated by liquids accumulating in tanks 22 and 23. The number of counts accumulating on counter 35 is indicative of the number of times that tanks 22 or 23 have accumulated liquids in a quantity adequate to actuate float switches 25 and 26. Relay R2 also is a means to provide an electrical signal to electronics apparatus 11 representative of a quantity of liquids in the fluid stream from the well being pumped by the rod pumping system. With an event recorder such as an electromechanical counter contained in controller 29 along with other described instrumentation and control mechanisms, measurement apparatus 4 can be employed as a stand alone quantitative measurement device to measure the quantity of liquids in a flow stream containing both liquids and gases. The measurement device also has the ability to transmit an electrical signal to electronic apparatus 11 for the purpose of analyzing these quantitative signals to measure and control the performance of the rod pumped system and simultaneously to measure changes in the capability of the reservoir to deliver fluids to the well bore.

OPERATION OF ALTERNATE EMBODIMENTS OF MEASUREMENT APPARATUS 4

The preferred embodiment of measurement apparatus 4 of the subject invention describes float switches, 25 and 26, illustrated in FIG. 10 to sense the quantity of liquids accumulating in tanks 22 or 23. Alternate methods may be employed to sense quantities of liquids accumulating in tanks 22 and 23. Some of these alternative methods of sensing the quantity of liquids accumulating in either of the tanks are illustrated in FIG. 13 and FIG. 14.

FIG. 13 illustrates a hydrostatic head switch 60 utilizing a single diaphragm 62 to detect the quantity of liquid present in either tank. Referring to FIG. 13, as liquids accumulate in tank 23, the hydrostatic pressure due to accumulating liquids will increase on tank 23 diaphragm side. This force will be opposed by spring 65. As liquids accumulate, spring 65 compresses because of accumulating liquids. As liquid previously accumulated in tank 22 are discharged, the liquid hydrostatic head of tank 22 decreases and will eventually disappear when all liquids in tank 22 have been discharged. When all liquids have been discharged from tank 22, only gas pressure is applied to the side of diaphragm 63 connected to tank 22. At some hydrostatic head in tank 23 (determined by the force of spring 65 and the position of switch 61), switch 61 will be actuated (opens) causing relay R1, controller 29, to be deenergized. The process is reversed as tank 22 then accumulates liquids and tank 23 discharges liquids which have previously accumulated. The position of diaphragm 63 reverses to actuate switch 62 (closes) energizing relay R1. The function and action of controller 29, relay R1, solenoids 33 and 34, and pneumatic signals 30 and 31 remain exactly the same as that previously described in the preferred embodiment as float switches 25 and 26 operate relay R1.

Another means of sensing a quantity of liquids accumulating in tank 22 and 23 is illustrated in FIG. 14. In this illustration load transducers are employed to sense the change in weight of tanks 22 and 23 as liquids accumulate in either of the tanks. In this instrumentation configuration, the output analog signal of the load transducers 70 and 71 is connected to a comparator circuit (not illustrated) of controller 29. When the weight of tank 22 or 23 (whichever is accumulating liquids) increases by an amount greater than that of the comparator adjustment, a switch is actuated to energize or deenergize relay R1 (controller 29), whichever the case, to alternately accumulate liquids in tanks 22 and 23.

In addition to providing an alternate means of sensing the quantity of liquids accumulating in tanks 22 and 23, alternate methods of mechanically positioning diverter mechanisms 27 and 28 may also be utilized. The preferred embodiment of the subject invention describes a pneumatically operated diverter mechanism illustrated in FIGS. 2 and 11. In either FIG. 2 or 11 the diversion of incoming and discharging fluids are alternated from tank 22 to tank 23 and vice versa by switching of pneumatic signals 30 and 31 caused by energizing and deenergizing solenoids 33 and 34 of controller 29. This is a very simple and straightforward means of accomplishing this function; but, on occasion, pneumatic power fluids (well head gas) has been known to cause significant problems from freezing or the plugging of ports in the solenoid valves 33 and 34 which switch pneumatic signals 30 and 31. An alternate embodiment of positioning diverter mechanisms 27 and 28 might employ a unidirectional electric motor as illustrated in FIG. 12.

In this illustration a single, unidirectional electric motor is employed to rotate diverter mechanisms 27 and 28 in response to relay R1 (controller 29) being energized or deenergized by liquid quantitative sensing means of tank 22 and 23. Since the inlet line 6 and discharge line 7 of measurement apparatus 4 are always fully open regardless of the position of either diverter mechanism 27 or 28, the pressure differential across these diverter mechanisms is very small. This feature reduces torque requirements of the unidirectional motor to only that required to overcome small frictional resistance of the diverter vanes and shaft seals both of which can be minimized because of low pressure differentials and relatively low internal pressures encountered in the application of the subject invention. An alternative switching circuit to position the electric motor driving diverter mechanisms 27 and 28 is also illustrated in FIG. 12. In this illustration relay R1 (controller 29) is alternately energized and deenergized by any of the liquid quantity sensing means (float switches 25 and 26, load transducers 70 and 71, or hydrostatic head switch 60 containing switches 61 and 62). As relay R1 is energized and deenergized, the electric motor positioning diverter mechanisms 27 and 28 is drive in 90 degree increments. In this positioning motion, relay R1 (controller 29) energizes the unidirectional motor. The electric motor will rotate until a cam attached to the motor shaft actuates a switch interrupting the power to the electric motor. It can be seen from the electrical schematic diagram that as relay R1 is energized the motor is driven 90 degrees and then when it is deenergized the motor is driven an added 90 degrees. This process is repeated which will alternately position diverter mechanisms 27 and 28 to alternately allow tanks 22 and 23 to accumulate liquids and discharge fluids.

OPERATION OF ELECTRONIC APPARATUS 11 OF THE PREFERRED EMBODIMENT

Referring back to FIG. 1 of the preferred embodiment, measurement apparatus 4 is connected to an electronic apparatus 11 by electrical signals 9 and 10 which are representative of a quantity of liquids being pumped by subsurface reciprocating pump 5. Electronic apparatus 11 is an electronic means of analyzing the quantitative liquid signals generated by measurement apparatus 4. Specifically, electronic apparatus 11 is used to determine the rate at which liquids are pumped by pump 5 and the average amount of liquids displaced each stroke of the pump as liquids accumulate in tanks 22 and 23.

FIGS 5, 6 and 7 illustrate the content and function of electronic apparatus 11 when employed to monitor both the performance of the subsurface pump 5 (illustrated in FIG. 1) and the performance of the reservoir (ability to deliver liquids to the well bore). In addition, electronic apparatus 11 may be used to control the efficiency of pump 5 by controlling the time the well is pumped, the speed of the pump (strokes per minute) or both speed and time pumped. In FIG. 5, electronic apparatus 11 consists principally of a microprocessor 36, memory (RAM/ROM) 37, a serial communications interface 39, a control and display panel 41, a calendar and time clock 38, and a power supply 40. Additionally, interface circuitry (relays, gates etc.) are required to interface quantitative signals 9 and 10, ON/OFF control outputs 13 to control panel 12, and RUN/STOPPED status signals 14 from control panel 12 to indicate whether the pump is running or stopped.

From the diagram of FIG. 5 the information signals from external devices are signals 9 and 10 representative of the quantity of liquids being pumped and the status signals 14 indicating whether the pumping unit is running or stopped. The instruction program for microprocessor 36 is contained in ROM (read only memory) 37. Data and information is stored in RAM (random access memory) 37. Pumping oil wells may be operated in several different ways to pump liquids from the well bore to the surface.

(1) Wells may be pumped continuously, 24 hours per day.

(2) Wells may be time controlled using a percentage timer (in control panel 12) that will allow the well to be pumped a fixed but adjustable percentage of time over a fixed but selectable interval. For example: A well may be pumped from 0 to 100% of a 15 minute, 30 minute, 60 minute, or other fixed interval. If the timer is adjusted to pump 50% of a 15 minute interval, the well will be pumped for 7½ minutes and remain off for 7½ minutes.

(3) The well may be pumped on a cyclic basis utilizing "pump-off controllers" to turn the pumping system off when subsurface pump 5 volumetric efficiencies decrease by some adjustable amount. Pumps so controlled are then shut in for some fixed but adjustable interval (when volumetric efficiencies decrease by a preset amount) to allow liquids to again accumulate in the well bore. After this shut in interval, the well is again started and the cycle repeated.

Electronic apparatus 11 in conjunction with measurement apparatus 4, or any other measurement device that will provide signals representative of the quantity of liquids being pumped may be used to determine the volumetric efficiency of pump 5. With such determinations electronic apparatus 11 may be used to monitor only, or if desired, used to automatically control the performance of subsurface pump 5.

In the preferred embodiment of apparatus 4, each time tank 22 or 23 accumulates enough liquid to actuate floats 25 or 26 (whichever tank is accumulating liquids), electronic apparatus 11 records the time required for such liquids to accumulate. For example: Assume switch 25 of tank 22 has just actuated. A signal is transmitted to electronic apparatus 11 indicating that tank 23 is now accumulating liquids. Electronic apparatus 11 will then begin to accumulate the time required for tank 23 to accumulate enough liquids to actuate float 26. When adequate liquids have accumulated in tank 23 to actuate flat 26 electronic apparatus 11 records the interval (time for actuating float switch 25 to the actuation of float switch 26). This is the time required for subsurface pump 5 to pump liquids to tank 22 with apparatus 11 recording the time required to accumulate liquids pumped to actuate float switch 25. This process is repeated as long as the oil well is pumping.

From these data (number of float switch actuations and the time between actuations) the following information may be computed by microprocessor 36 and stored in RAM memory 37.

(1) Volume of liquids being pumped may be computed simply by recording the number of impulses or actuations of float switches 25 and 26. These impulses may be converted to any convenient engineering units by multiplying the number of impulses recorded by some conversion factor. For example: if each tank requires the accumulation of 4.65 gallons of liquid to actuate each of the float switches, the factor would be 4.65/42=0.1107 to indicate the volume in 42 gallon barrels.

(2) The actual liquids that are displaced by the pump may be computed. The actual liquid volume displaced by the pump per stroke may be obtained using the following equation:

V/N where:

V=Volume of liquid accumulate in either tank. (4.65 in previous example).

N=Number of strokes during the elapsed time between float switch actuations as described. (Assume 20 strokes to pump 4.65 gallons.)

Example: V/N=4.65/20=0.2325 gallons per stroke.

It is obvious that to be able to compute the displacement per stroke of subsurface pump 5 from a knowledge of the volume of liquids in each tank accumulation and the time required for this accumulation, the speed of the pump (strokes per minute) must be known or must be constant. The great majority of wells pumped in the United States are pumped using sychronous electric motors which, for practical purposes, are constant speed. With constant speed electric motors, the displacement may be computed by manaully recording the speed of the pumping system using a stop watch (strokes per minute) and entering this speed into computer RAM memory 37 using display entry panel 41.

With the speed being constant, the time required for liquids to accumulate in each tank (22 or 23) may be used as an indication of change in actual liquids displaced by subsurface pump 5. Actually, the time required is inversely proportional or the reciprocal of the actual liquid displacement of the pump. As result it is easy to observe the change in pump 5 liquid displacement by monitoring time change required for liquids to accumulate to actuate float switches 25 or 26. (The longer the time required for liquids to accumulate to actuate the float switches, the less is the liquid displacement per stroke). This means that a decrease in the volumetric efficiency (or actual liquid displaced by the pump) may be detected by detecting a specific increase in the time between the actuation of switches 25 or 26. To accomplish this, the operator adjusts the "Fill Time Limit" of display entry panel 41 (SELECT function V) to some value exceeding a "normal" time value for liquids necessary to operate either float switches 25 or 26. As an example, the operator may use a stopwatch to observe how long it takes to accumulate the necessary liquids to actuate either float switch. Assume that this manually observed time is 30 seconds. The operator then sets the "FILL TIME LIMIT" (V) by turning the SELECT knob 45 (clockwise or counterclockwise) until the left hand alpha character of display 42 (panel 41) changes to "V". When "V" appears in the display (left hand character) the operator then adjusts the numeric entry (right hand characters) to some value above 30 seconds by turning the ADJUST knob (clockwise or counterclockwise). Assume 33 seconds. This FILL TIME LIMIT entry will represent a 10% decrease in volumetric efficiency of subsurface pump 5. As oil wells are pumped at a rate in excess of the reservoir's ability to deliver liquids to the well bore, the liquid level in the annulus of the well decreases (falls). As this liquid level in the annulus falls and assuming that gas casing pressure remains constant, the pressure at subsurface pump inlet decreases. This decrease in pressure will allow any entrained gas in the annulus liquids to expand and may also permit some volume of dissolved gases in the oil to break out of solution creating additional entrained gas bubbles. These gas bubbles entrained within the annulus liquids will enter the subsurface pump barrel on the upstroke of the pump occupying an increasing percentage of the pump barrel volume. These expanding entrained and dissolved gas volumes will cause decreased volumetric efficiencies as the well is pumped down.

The rate of decrease in volumetric efficiency due to this cause will vary considerably with the nature of the reservoir fluids (viscosity, percent water, entrained gas characteristics, and solution gas volumes and pressures). When liquid levels are near or at the pump suction, some free gas in the annulus (gas above the liquids) may be drawn into the pump barrel in significantly larger volumes causing a much more rapid decrease in pump volumetric efficiency. This condition in a rod pumped oil well is generally called "pump-off". The exact level of liquid in the annulus with respect to the pump inlet may vary but, in general, the level is at or near the inlet of the pump. Regardless, the "pumped-off" condition is undesirable since the decreased efficiency requires more electrical power per unit of liquid pumped. Additionally, these "pumped-off" conditions accelerate the wear on the pumping equipment to increase maintenance costs. The subject invention, a pump optimization system, comprising of a measurement apparatus 4 and an apparatus 11 to analyze the output from the measurement apparatus 4 may be used in a monitor only mode or a monitor and control mode. In a monitor only mode, the time a well is pumped is controlled by a percentage timer which is normally a standard component of control panel 12 (FIG. 1) and is manually adjusted by a well operator to keep the well pumped down (annulus levels near the pump inlet) and at the same time to minimize "pumped-off" condition to reduce electrical costs and minimize wear and maintenance. A typical cycle for a pumping well utilizing a percentage time to control the cycle is illustrated in FIG. 8. This figure is a plot of actual liquid pump displacement (gallons per stroke) versus time.

(1) T0 is the time at which the percentage timer in control panel 12 starts the electric motor to start subsurface pump 5.

(2) T1 is referred to as "Pump Up Time" and is indicated by the first actuation of either float switch 25 or 26 after the pump is started by the percentage timer.

(3) T2 is the point at which "Pump-Off" condition is declared. This condition is detected by apparatus 11 when the time required to accumulate enough liquids to actuate the float switch in either tank 22 or 23 equals or exceeds the FILL TIME LIMIT (Example: 33 seconds)

(4) T3 is the time at which the percentage timer turns the pumping unit off to allow liquids to again accumulate in the annulus.

(5) T0 is the time at which the cycle starts again.

Elapsed time of FIG. 8 and some explanations:

(1) T0 to T1 "PUMP UP TIME" is the elapsed time from the starting of the pump until the first actuation of either float switch 25 or 26 in tanks 22 or 23. This time is usually a function of the IDLE TIME (T3 to T0) and also changes in pumpup time are indicative of the condition of the pumping system.

Conditions that will cause "pump up time" to increase:

(a) Leaks in the tubing allowing liquids to drain from the tubing to the annulus during IDLE TIME.

(b) Leaks in the standing value of the pump allowing liquids to drain through the standing valve to the annulus during IDLE TIME.

(c) Wear in the pump system (standing valve, travelling valve, pump barrel, and pump plunger) all of which decrease liquids displaced each stroke of the pump.

(d) Longer IDLE TIME allowing more time for liquids to drain from the tubing to the annulus for whatever reason.

(2) T1 to T2 Normal pumping time when the well is not in a "pumped-off" condition. This is the most efficient portion of the pumping cycle. It may be noted that the liquid displaced each stroke is highest immediately after "pump-up" and then gradually decreases to T2, a point in time just before "pump-off". This decline in volumetric efficiency is due to expanding entrained gas bubbles within the accumulated liquids in the annulus as pressures at the pump inlet decline during the pump down cycle. Over long time intervals (many pump cycles), pump wear occurs, leaks develop in the pump system components, or restrictions develop to the flow of liquids from the annulus to the pump barrel which cause pump volumetric efficiencies to be reduced from that which is normal for the time period from T1 to T2.

(3) T2 to T3 Pumping time from the beginning of "pump-off" until the percentage timer shuts the pumping unit down to allow liquids to again accumulate in the annulus. This is the most undesirable part of the pumping cycle. This is a period where electrical cost per unit of liquid pumped is greatest; and, is also a period of accelerated wear caused by increased stresses and shocks to pumping system components. Most operators, when adjusting percentage timers attempt to minimize this period; but, because there is the desire to maximize production (daily revenue) they also want to keep the well pumped down to minimize well bore pressures (pump inlet pressures). As a consequence, most wells pumped using percentage timers as the control means to control pump cycles tend to be overpumped (pumped for some time during a "pumped-off" condition).

(4) T3 to T0 IDLE TIME This is the period when the pumping unit is stopped to allow liquids to accumulate in the annulus before again starting the pump. This time period can affect the daily volumes of liquids delivered by the reservoir to the well bore resulting in a change in the volumes of liquid available to be pumped. When the pump unit is stopped to accumulate liquids in the annulus, pressures increase at the pump inlet because of the accumulation of liquids in the annulus (casing gas pressure assumed constant). This increased pressure (liquid hydrostatic head in the annulus) will restrict the flow of fluids from the reservoir to the annulus (well bore). Adjusting IDLE TIME to an "optimum" time can be difficult utilizing percentage timers or conventional "pump-off" controllers. With percentage timers once the percent ON TIME has been adjusted to minimize "pump-off", the OFF TIME is determined by the interval (15, 30, 60, 90, etc. minutes) of the percentage timer. This cannot be changed without changing the timing interval of the percentage timer. The IDLE TIME is not independently adjustable using conventional percentage timers. To change the IDLE TIME the percentage timer interval must be changed which implies changing the timing unit which is time consuming and somewhat expensive. As a result, IDLE TIME adjustments to maximize produced liquids are compromised by the mechanics of the percentage timer.

The majority of rod pumping systems in the United States still employ percentage timers to control pumping time to optimize, as much as possible, the performance of the pumping system. A number of reasons advanced for utilizing percentage timers for this function, in spite of the limitation discussed, are as follows:

(1) Automatic "pump-off" controllers are too expensive to provide adequate returns.

(2) Automatic "pump-off" controllers are too difficult and expensive to maintain.

(3) Automatic "pump-off" controllers are too difficult for present field personnel to operate and understand.

In cases where operators, for whatever reason, choose to control pumping times with presently installed percentage timers, the subject invention, the pump optimization system, in a monitor only mode, may be used to monitor the performance of the rod pumping system and data acquired by the pump optimizer may be employed to more precisely adjust presently installed percentage timers more frequently and at the same time identify well and reservoir problems.

To accomplish this monitoring function, the pump optimizer records the following data for each pump cycle from START to STOP to START of the pumping cycle controlled by the percentage timer. Refer to FIG. 6:

(O & H) Volume of liquids pumped from pump start to pump stop (T0 to T3)

(P & I) Volume of liquids pumped from pump start to "pump-off" (T0 to T2)

(Q & J) Time from pump start to pump up (T0 to T1)

(R & K) Time from pump up to "pump-off" (T1 to T2)

(S & L) Time from "pump-off" to pump stop (T2 to T3)

(T & M) Time for pump stop to pump start (T3 to T0)

(U & N) Time for liquids to accumulate in tank 22 or 23

These data are recorded for a 24 hour period in addition to being recorded during the cycling of the pump by the percentage timer. These data are available for local display (FIG. 6) to field personnel for their evaluation and use. These data may also be acquired from time to time using communications interface 39 of electronic apparatus 11. These data may be acquired locally using a portable data acquisition unit or data may be acquired through any communications media to some centralized computer.

For a 24 hour elapsed interval the following data is summarized.

(A) Total produced (pumped) volume of liquid—Obtained by summing (item O & H) above) for each pump cycle for a 24 hour period.

(B) Total volume pumped from pump start to "pump-off"—Also obtained from summarizing (item P & I above) during the pump cycles controlled by the percentage timer.

(C) Number of pump cycles obtained by recording the number of start/stop/start events of the percentage timer—a status input from control panel 12 to microprocessor 36 of apparatus 11.

(D) Total run time of pump for 24 hours—Obtained by recording the time the percentage timer has the well pumping for the 24 hour period.

(E) Run time during pump-up—Obtained by summing (item Q & J above) during individual pump cycles.

TABLE 1

SINGLE PUMP CYCLE DATA

| ITEM (FIG. 6) | DESCRIPTION | DATA | UNITS |
|---|---|---|---|
| H | Volume from pump start to pump stop | 46.5 | Gal. |
| I | Volume from pump start to pump off | 39.2 | Gal. |
| J | Time from pump start to pump up | 0.5 | Min. |
| K | Time from pump up to pump off | 7.5 | Min. |
| L | Time from pump off to pump stop | 2.0 | Min. |
| M | Time from pump stop to pump start | 5.0 | Min. |
| N | Time to Acc. Liq. Tank 22 or 23 | 33.0 | Sec. |

If the percentage timer controlling the pump cycle is a 15 minute cycle timer, the number of START-STOP-START pump cycles will be 1440/15=96 cycles in a 24 hour period. The total time is composed of J, K, L and M increments illustrated above in Table 1 and will be 15 minutes. J+K+L+M=Total Cycle Time=15 Minutes. In Table 1 above 0.5+7.5+2.0+5.0=15 minutes. The total liquids pumped during the pump cycle is 46.5 Gallons are measured by apparatus 4 and recorded by apparatus 11.

From Table 1, volumes pumped during each time increment are as follows:

TABLE 2

VOLUME PUMPED EACH INCREMENT OF TIME CYCLE

| INCREMENT | TIME-MIN. | VOLUME-GAL. |
|---|---|---|
| J | 0.5 | 0.0 |
| K | 7.5 | 39.2 |
| L | 2.0 (46.5–39.2) | 7.3 |
| M | 5.0 | 0.0 |
| TOTAL TIME | 15.0 | 46.5 |

Average efficiency loss of pump after "pump-off" occurs may be computed using the following equations.

$$\text{Eloss} = \frac{(Vbpo/Tk) - (Vt - Vbpo)/T1}{Vbpo/Tk} \times 100$$

Eloss = Efficiency loss (percent)

WHERE:

Vbpo=Volume pumped from pump up to pump off
Tk=Time from pump up to pump off
Vt=Volume pumped from pump start to pump stop
T1=Time from pumpoff to pump stop

USING VALUES FROM TABLE 1

$$\text{Eloss} = \frac{(39.2/7.5) - (46.5 - 39.2)/2.0}{39.2/7.5} \times 100 = 30.16\%$$

As stated previously, the pumping time from "pump off" to pump stop (F,L,S, FIG. 6) is undesirable. In the example (Table 1) there is an average 30% volumetric efficiency loss during this time period during each cycle; but, in addition, wear on pumping system components is accelerated because liquids fail to fill the pump barrel on the upstroke of the pump. In the particular example illustrated, the 2 minute period during each cycle that the well is pumping at reduced efficiency amounts to over 3 hours per day at this inefficient rate.

Data collected each cycle and each 24 hours by apparatus 11 may be used by the operator to determine the adjustments required to the percentage timer to reduce time increment (F,L,S) to near zero using the following equations:

$$Qp = Vbpo/Tk$$

and $$\text{New } Tk = Vt/Qp + Tj$$

WHERE:

$Q_p$=Pump rate—gallons/min. from pump up to pump off
Vbpo=Volume pumped from pump start to pump off
Tk=Time from pump up to pump off
Vt=Volume pumped from pump start to pump stop
Tj=Time from pump start to pump up

EXAMPLE:

Qp=39.2/7.5=5.23 Gallons per minute pump rate
New Tk=46.5/5.23+0.5=9.39 Minutes
Percentage setting=9.39/15=62.6% ON TIME
5.61/15=37.4% OFF TIME By setting the ON TIME of the percentage timer to 62.6%, or 9.39 minutes, the IDLE TIME of the pump each cycle will be increased from 5 minutes to 5.61 minutes. Whether or not this adjustment will affect the reservoir deliverability by any measurable amount can only be determined by subsequent production data recorded by apparatus 11 after timing adjustments have been made.

Using data recorded in the manner described, it is obvious that it is possible to use the pump optimization system, consisting of measurement apparatus 4 and electronic apparatus 11 to monitor the performance of rod pumping systems controlled by percentage timers. Also using these data recorded and displayed, an operator is able to manually adjust percentage timers to more closely match the pumping capacity of the pump to the ability of the reservoir to deliver liquids to the well bore to improve performance of the pumping system. Utilizing the pump optimization system in this manner, to monitor pump performance and to manually adjust percentage timers, it is possible to move the pump optimization system from well to well to permit the operator to make temporary observations regarding performance and adjust the percentage timer to improve efficiency or to increase production should the well be underpumped.

USING THE PUMP OPTIMIZATION SYSTEM TO CONTROL PUMP PERFORMANCE AUTOMATICALLY AND TO QUANTITATIVELY IDENTIFY PUMP INEFFICIENCIES AND RESERVOIR PROBLEMS

To achieve added improvements to the pumping system and to the mechanics of recovering liquids from the oil reservoir, the pump optimizer may be used to automatically adjust pumping time and idle time (time the pump is stopped to allow liquids to accumulate in the annulus before restarting the pump).

Actual liquid displacement (Gallons per stroke) versus pump cycle time is illustrated in FIG. 9 when the pumping system cycle time is automatically controlled by the pump optimizer. If FIGS. 8 and 9 are compared, it can be seen that times T2 and T3 occur at the same time; i.e., there is no elapsed time period between the time when "pump off" conditions are detected and when PUMP STOP control occurs since the pump optimizer will automatically STOP the pump for some fixed but adjustable IDLE TIME (elapsed time pump is stopped for liquid accumulation in the annulus). Times T0, T1, T2, T3 and the elapsed time intervals (T0 to T1), (T1 to T2), (T3 to T0) remain exactly the same as that described when the pump optimizer is used in the monitor only mode. The only exception is that there is no elapsed time interval between (T2 to T3) in the automatic control mode. In the automatic monitoring and CONTROL mode, operator entries to apparatus 11 utilizing control and display panel 41 are as follows:

TABLE 3

| OPERATOR ENTRIES FOR AUTOMATIC CONTROL | | | |
|---|---|---|---|
| ITEM | DESCRIPTION | EXAMPLE | UNITS |
| V | Fill time limit | 33 | Sec. |
| W | Pump up time limit | 2:30 | Min. Sec. |
| X | Off (IDLE) Time | 1:50 | Min. Sec. |

A description of these entries and their utility is as follows:

V (FULL TIME LIMIT ADJUSTMENT)

This is the limit of time required for liquids to accumulate in tank 22 or 23 to actuate float switches 25 or 26. When the FILL TIME or liquid accumulation time of either tank 22 or 23 equals or exceeds this fixed but adjustable limit, "pump off" conditions are declared by apparatus 11, microprocessor 36 and the well pumping system is stopped by control signal 13 from apparatus 11 to control panel 12 to deenergize an electric motor contactor that interrupts electrical power to electric motor 16.

The FILLTIME LIMIT (V) may be adjusted manually or automatically. The display and control panel 41 FIG. 5 and FIG. 6, illustrate a manual adjustment means. In this illustrated case, manual entry of FILL TIME LIMIT V, the operator determines the "normal" liquid accumulation time of tank 22 and 23 (measurement apparatus 4) by observing the elapsed time on a stop watch as liquid accumulates to actuate float switches 25 or 26. An average time of two to three liquid accumulation cycles after "pump up" occurs at the beginning of a pumping cycle is adequate to determine a "normal" liquid accumulation cycle time. "Normal" accumulation time is defined as the accumulation time required when the well is pumping with some liquid accumulation in the annulus (the well is not in a "pumped off" condition). If it is assumed that 3 liquid accumulation times were 29, 30 and 31 seconds respectively, the average time of liquid accumulation for these three cycles would be $(29+30+31)/3=30$ seconds. The operator, after obtaining the "normal" liquid accumulation time would then add 10 to 15% to this observed time—$(30\times 1.10$ to $1.15\%)=33$ to 34.5 seconds. The operator would then enter this limit into RAM memory 37 of apparatus 11 by turning the SELECT knob 45 of display entry panel 41 until the alpha character "V" appears in the left hand character of display 42. When this alpha character appears, the operator then rotates ADJUST knob 44 (clockwise to increase, counterclockwise to decrease) until the numerical characters read 33 to 34.5 seconds (10 to 15% increase over "normal" liquid accumulation cycle time).

W (PUMP UP TIME LIMIT ADJUSTMENT)

Pump up time is defined as the elapsed time from PUMP START to the time of the first float switch actuation (25 or 26 in tanks 22 or 23). In an automatic control mode, the levels of liquid in tank 22 or 23 when the pump is automatically stopped because of decreased pump 5 efficiency, will be very near the level of the float switches. This means that when liquids first appear at the surface after PUMP START only a very small volume of liquids will be required to actuate either float switch. The pump up time limit may be set at some arbitrary time from 2 to 5 minutes at the initiation of the operation of the pump optimizer. PUMP UP TIME LIMIT SETTING is not critical initially. It is used principally to detect pump system "failure" such as: ROD PARTS, TUBING RUPTURES, TRAVELLING OR STANDING VALVE HANGING OPEN. Any pump system failure of these types will result in no liquids being pumped from the well (pump volumetric efficiency 0). When actual pump up time exceeded pump up time limit, the normal conclusion would be that the pumping system had "failed". The surface beam would be operating but no liquids would be pumped. Under these circumstances, the pump would be STOPPED. After the IDLE TIME again elapsed the pump would again be STARTED and if PUMP UP TIME LIMIT were exceeded for three (3) consecutive times the pumping system would remain STOPPED. After the initial and arbitrary setting of the PUMP UP TIME LIMIT, and after the pump optimizer had operated for some few pump cycles or a 24 hour period, the actual PUMP UP TIME could be observed at (J), (Q), (E) positions of SELECT knob 45 of control display panel 41 on display 42. This value may then be used to adjust PUMP UP TIME LIMIT. This limit may be adjusted 200 to 300 percent in excess of that which is observed on the display. Assuming the observed PUMP UP TIME to be 30 seconds, the value entered by the operator would be $(30\times 2.00$ to $3.00)=(1{:}00$ to $3{:}00$ min:sec).

X (IDLE TIME ADJUSTMENT)

OFF TIME (IDLE TIME) is the time the well is stopped to allow liquids to again accumulate in the annulus of the well. The adjustment of this value can affect both the volume of production from the well and the cost of operation. As a consequence, the adjustment of this value can affect profitability. In general, longer IDLE TIME results in reduced costs—improved pump efficiencies—longer pump cycle (reduced START STOPS over specific time intervals) and reduced maintenance because of improved efficiencies and fewer START/STOPS. Shorter IDLE TIME results in the opposite—decreased pump efficiencies and increased maintenance. On the other hand, longer IDLE TIME results in less production, shorter IDLE TIME results in more production. From these generalities it can be seen that adjusting IDLE TIME will be a compromise between increased production and reduced costs to realize maximum profitability.

Establishing the optimum IDLE TIME is not as simple as establishing the optimum pumping (ON) time. Measuring the change in costs or measuring the change in production with small changes in IDLE TIME have been difficult. The pump optimization system provides a direct means of measuring the effect of IDLE TIME on production. Apparatus 11 records the volume pumped (measured by apparatus 4) each pumping cycle from PUMP START TO PUMP STOP and also records the sum of these cycle data for a 24 hour elapsed time period.

Any change in production as a result of changes in IDLE TIME may be observed at positions (A), (H), or (O) of SELECT knob 45 on display 42 of control/display panel 41 of apparatus 11. (A) position displays a 24 hour period. (O) position displays the volume of liquids pumped during the current pumping cycle and (H) position displays the volume pumped during the last pumping cycle. To determine changes in pumped liquid volumes with a change in IDLE TIME, the operator should incrementally increase or decrease IDLE TIME and then observe and note any change in pumped liquids. Short term observations may be viewed at position (H) and (O). Longer term observations may be made using (A) position of the SELECT knob. When no changes in pumped volumes are realized when incrementally decreasing or increasing IDLE TIME, production volumes can be said to be "Optimized". In effect, the IDLE TIME should be adjusted to the maximum time possible and yet not significantly decrease production. Whether this IDLE TIME results in the optimum operating costs is another consideration. To determine this, some statistical information is required relating IDLE TIME to electrical power consumption and increased wear and maintenance on pumping system components. In any event some judgement must be exercised in the adjustment of IDLE TIME to optimize profits (minimizing costs/maximizing production).

AUTOMATIC ADJUSTMENT OF CONTROL LIMITS (POSITIONS [V], [W], [X])

While the preceding discussion describes a means of manually adjusting and entering the limits (FILL TIME LIMIT, PUMP UP TIME LIMIT, AND OFF TIME) it is possible and feasible to provide a means of making these entries automatically. This automatic entry of these variables would have the advantage of being independent of local operator entry or interaction when placing the pump optimizer in operation.

(V) AUTOMATIC FILL TIME ADJUSTMENT

This adjustment would be accomplished by a software routine resident in ROM 37 of apparatus 11 and executed by microprocessor 36. This routine would execute the following instructions;

(1) Sum the first three tank accumulation cycles each pumping cycle after "pump-up" had occurred (actuation of float switch 25 or 26 of tank 22 or 23).

(2) Compute an average accumulation time for these first three accumulation cycles.

(3) Increase this computed average accumulation time by 10% (multiply average value by 1.10)

(4) Place this increased value in RAM memory 37 to be used as the limit for the detection and declaration of "pump-off" conditions.

The 10% value increase in average "normal" accumulation time is a fixed (fallback) value resident in ROM 37 memory. If for some reason this value (10%) is unsatisfactory and requires modification the percentage adjustment (increase) may be altered by the operator by rotating SELECT knob 45 to position (b) and then rotating ADJUST knob 44 to the desirable percentage value. This manually modified value is then placed in RAM memory 37 and used in lieu of the fixed 10% value resident in ROM memory. This altered value is then used to compute the (FILL TIME LIMIT) (V) to be employed in detecting "pump-off" conditions.

An automatic means of computing the FILL TIME LIMIT (V) that is to be used for detecting "pump-off" condition has the following advantages:

(1) Requires no operator action to initiate the unit.

(2) There is an automatic computation and readjustment of the FILL TIME LIMIT each pump cycle which will automatically compensate for any short or long term wear or malfunction of the pumping system components. This means that during EACH pumping cycle from START TO STOP, "pump-off" condition is detected by a CHANGE in the pump volumetric efficiency for that particular pumping cycle-not simply detecting when volumetric efficiencies fall below some fixed (manually adjustable) value.

(W) AUTOMATIC ADJUSTMENT OF PUMP UP TIME LIMIT

As pointed out in previous discussions, pump up time limit value is not critical from a control standpoint since this limit is only used to detect "catastrophic" failure—failures that result in pumping volumetric efficiencies falling to zero (0) or near zero. In this case, some value of PUMP UP TIME LIMIT is stored in ROM memory 37 (Example: 4:00 minutes). This value, stored in ROM memory, is a "fallback" value and used in the event the operator does not enter any PUMP UP TIME LIMIT. In general, this value greatly exceeds the "normal" pump up time and will be used to shut the pumping system off permanently if the pumping system fails to achieve "pump-up" after 3 consecutive pump STARTS. Such a procedure for permanent shut down is illustrated as follows:

(1) PUMP START is executed by microprocessor 36, apparatus 11 after IDLE TIME elapses.

(2) If the pump run time equals or exceeds the 4:00 minute fallback value in ROM (PUMP UP TIME LIMIT) the well is shut down.

(3) IDLE TIME again expires and the pumping system is RESTARTED. The pumping time again exceeds 4:00 and the pumping system is again shut down.

(4) After this process is repeated one more time (STARTING the unit and then pumping until the 4:00 minute pump-up time limit is exceeded) the pumping system is shut down until the operator goes to the well site to correct the problem and reset the pump optimizer.

In this instance, as was the case with the automatic adjustment of FILL TIME LIMIT, the operator has the ability to override the 4:00 minute limit stored in ROM memory by rotating the SELECT knob 45 to the (c) position (left hand character of display 42 displays "c"), and then adjusting the PUMP UP TIME LIMIT to any value desired (XX:YY—Mm:SS) by rotating the ADJUST knob 44. The only advantage of the automatic adjustment of the PUMP UP TIME LIMIT to that stored value in ROM memory 37 is that no operator entry is required.

(X) AUTOMATIC OFF TIME (IDLE TIME) ADJUSTMENT

There are probably some complex control algorithms that might be employed to automatically adjust the OFF TIME (IDLE TIME) to optimize both the performance of the pumping system and the reservoir, but since reservoir characteristics change from well to well and the relationship of operating costs and IDLE TIME also change from well to well, any equation to define IDLE TIME would be very complex. As a consequence, the only method of automatic adjustment of IDLE TIME is to store some nominal value (EXAMPLE: 5:00 minutes) in ROM memory 37 or apparatus 11 as a fallback value to be used in the event the operator fails to enter any value in RAM memory.

Should the operator wish to adjust the IDLE TIME value to any value other than that stored in ROM memory, he rotates the SELECT knob 45 to position (d)—until left character of display 42, FIGS. 5 and 6 reads "d". When "d" is displayed in the left hand character of this display, the operator rotates the ADJUST knob 44 until the desired IDLE TIME appears in the right hand characters of display 42, control panel 41. This value now stored in RAM memory will then be used as the IDLE TIME in lieu of the value stored in ROM memory as a fallback value. In summary there are advantages to be gained utilizing AUTOMATIC ADJUSTMENT of FILL TIME LIMIT, PUMP UP TIME LIMIT, and IDLE TIME.

(1) The operator is not required to make any entries or adjustment to the pump optimizer when initially placing the unit in operation.

(2) Automatic adjustment of the FILL TIME LIMIT has the advantage of automatically compensating for short and long term changes in volumetric efficiencies of the subsurface pump due to wear, obstructions, or malfunctions.

(3) Automatic adjustment of FILL TIME LIMIT has the advantage of compensating for pumping system speed (strokes per minute) changes as long as speed remains constant during the period from PUMP START to PUMP OFF in a single pumping cycle.

MONITORING AND CONTROLLING SPEED CHANGE IN ROD PUMPING SYSTEMS

For the most part, the discussion of the application of the pump optimization system to rod pumping wells has assumed that the pumping units were pumping at constant speeds (strokes per minute). This is because the majority of the rod pumped wells in the United States are pumped at a constant speed. Any speed adjustment to such wells is usually accomplished manually by changing sheave sizes of the belt drive between the electric motor and the gear reduction unit driving the crank arm whose action through the beam causes the subsurface pump to reciprocate. Once sheave size change has been accomplished, the pump will again reciprocate at a constant rate (strokes per minute). If the pump optimization system utilizes the AUTOMATIC FILL TIME ADJUSTMENT FEATURE no limit setting adjustment is required to any of the limits since the FILL TIME LIMIT will automatically adjust to any decrease or increase in pump rate caused by manually changing sheave sizes of the pumping unit. If the pump optimization system, on the other hand utilizes the MANUAL FILL TIME LIMIT ADJUSTMENT, then the operator must manually adjust the FILL TIME LIMIT to compensate for any increase or decrease in liquid accumulation times in tank 22 or 23 of measurement apparatus 4 caused by changing pump speed.

There are many rod pumped wells in the United States and internationally that are driven by gas engines rather than synchronous electric motors. The speed control devices on many of these units are not the most dependable and, as a result, there is considerable speed deviation during the operation of these wells from hour to hour and day to day. In addition, many operators are reluctant to employ START/STOP/START devices on gas engine driven pumping units because of the difficulty in getting gas engines to restart after being stopped. As a consequence, operators usually operate gas engine driven systems continuously. Operating these units at optimum speeds is difficult.

The subject pump optimization system provides a means for an operator to optimally adjust the speed of the gas engine both manually or automatically. Since the gas engine driven systems operate at variable speeds (intentionally and unintentionally) a means of measuring the speed (strokes per minute) is desirable. Such a means for monitoring this speed is illustrated in FIG. 23, item 50. This speed monitoring unit consists of a magnet attached to the crank arm of the pumping unit in such a manner as to cause the reed switch to open/close or close/open as the magnet rotates in proximity to the reed switch. On each rotation of the crank arm (one up and down stroke of the reciprocating pump), a signal is transmitted to microprocessor 36, apparatus 11 by the reed switch. This signal is used by microprocessor 36 to compute the speed (strokes per minute of the pump each stroke), and, in addition, these signals are accumulated to compute the average speed of the pumping system during each liquid accumulation cycle of tanks 22 or 23 of apparatus 4. With a knowledge of the volume of liquids accumulated in a liquid accumulation cycle, the time required for liquid to accumulate, and the average speed (strokes per minute) during the liquid accumulation cycle, it is relatively simple to compute the average liquid displacement of each stroke during each liquid accumulation cycle of tanks 22 or 23.

If the operator chooses to manually adjust the speed of the gas engine to optimize performance, a procedure that would be employed is as follows:

(1) Set governor speed of the gas engine to a minimum speed setting at some pump rate less than that of the ability of the reservoir to deliver liquids to the well bore. This will allow liquid levels to rise in the annulus to increase the liquid submergence of the subsurface pump.

(2) Allow the well to pump at this minimum rate (minimum speed) for some fixed time period during which the liquid level will rise in the annulus.

(3) At the end of this interval (EXAMPLE: 15:00 minutes), the operator then adjusts the governor at some higher (maximum rate) and allows the well to pump at this rate until the well indicates that it has been pumped-off as manifested by a decrease in the pump volumetric efficiency below some present limit.

(4) From an observation of the following data the operator may then estimate the approximate speed of the pump unit to match the ability of the reservoir to deliver liquids to the well bore.

| DATA | Vol/Gal | Gal/St | PmpTime | ST. | SPM |
|---|---|---|---|---|---|
| (1) Vol. Pumped at MinRate | 38.8 | 0.53 | 15:00 | 75 | 5.0 |
| (2) Vol. Pumped at MaxRate | 107.2 | 0.50 | 15:00 | 213 | 13.2 |
| (3) Tot. Vol. MinRate & MaxRate | 147.0 | 0.51 | 30:00 | 288 | — |

The approximate speed required to keep the well pumped down and minimize "pump-off" may then be computed using the following equation:

$$Sspm = Vt/(Tmin + Tmax)\ (Vs\ avg.)$$

Where:

Sspm = Approximate speed required to keep well pumped down

Vt = Tot. vol. pumped at min. & max. speeds (30:00 min.)

Tmin = Time well pumps at min. speed (5.0 strokes/-min.)

Tmax = Time well pumps at max. speed (13.2 strokes/min.)

Vsavg. = Average liquid displacement at min. and max. speeds

Using values in the example:

$$Sspm = 147.0/(15{:}00 + 15{:}00)\ (0.51) = 9.61 \text{ strokes per min.}$$

The operator would then set the governor to run the pumping unit at 9.61 strokes per minute. This would, in effect, pump the well at a rate to keep liquid levels low in the annulus; but, at the same time, avoid "pump-off" conditions detrimental to the pumping system components. The problem associated with running the pumping system at constant speed and closely matched to the productivity of the reservoir is as follows:

(1) If the volumetric efficiency of the pumping system changes (decreases), and reservoir productivity remains constant, the well will no longer be pumped down (liquid levels near the pump inlet but not "pumped-off"). This means that there may be some loss of daily production equal to the loss in volumetric efficiency of the subsurface pump.

(2) If reservoir productivity (inflow performance) increases, the well will be underpumped (assuming no change in pump volumetric efficiency) since the constant speed of the pump will not adapt to increased inflow from the reservoir. Here again, daily production will be less than that which is possible if all liquids produced by the reservoir were pumped to the surface.

(3) If reservoir inflow performance decreases, the well will be overpumped (pumped continuously in a "pumped-off" condition) which is detrimental to pump performance.

However, if the operator continuously (daily) observes data from the pump optimizer he will be able to detect decreases in the inflow performance of the reservoir or degradation of the pumping system performance by noting a decrease in liquid displacement per stroke from previously observed values (0.50 to 0.53 gallons per stroke in the example). The operator will be able to determine whether the pumping system volumetric efficiencies have changed or reservoir inflow performance has changed by manually decreasing the speed of the pumping system and observing the actual liquid displacement of the pumping system by monitoring the number of strokes required for a liquid accumulation cycle in tank 22 or 23.

(1) If actual liquid displacement increases substantially (10% or more) when speeds are decreased, there is good probability that the reservoir inflow performance of the reservoir has changed (decreased).

(2) If actual liquid pump displacement remains approximately the same with a decrease in speed, there is good probability that pump displacement efficiency has been reduced (worn pump) rather than any change in the inflow performance of the reservoir.

The most desirable method of controlling the speed of a gas engine driven pumping system is to utilize a variable speed technique to keep the well pumped down and yet minimize "pump-off" conditions.

Such a procedure for controlling the speed of a gas engine driven pumping system is as follows:

(1) An electrically switchable dual speed control for the gas engine whereby the pump optimization system alternately switches from a minimum speed to some maximum speed.

(a) Maximum speed may be adjusted by the governor located on the gas engine. This maximum speed is adjusted such that the pumping rate is in excess of the inflow capacity of the reservoir causing any liquid that may have accumulated in the annulus to fall to the pump inlet.

(b) Minimum speed is adjusted by a fuel gas regulator which will restrict fuel supply to cause the gas engine to run at some adjustable minimum speed. The minimum speed adjustment is not critical as long as the pumping rate at minimum speed is somewhat below that of the inflow rate of the reservoir. This will cause liquids to accumulate (rise) in the annulus of the well creating greater pump submergence.

(2) The pump optimization system provides the means to automatically switch from minimum speed to maximum speed and vice versa. The pump optimization system will monitor pumped volumes and liquid displacement each stroke during the time intervals at which the pumping system is operating at both minimum and maximum speed.

(3) The operator adjusts both the minimum and maximum speeds as described.

(4) The operator also adjusts the time interval at which the gas engine driven pumping unit operates at the adjustable minimum speed by utilizing SELECT knob 45, control panel 41, apparatus 11 (FIGS. 5 and 6) and ADJUST knob 44, control panel 41. This time interval, the pumping rate at minimum speed, and the inflow performance of the reservoir determine the volume of liquids that will accumulate in the annulus during this minimum pumping speed interval. This is analogous to stopping the pumping system when a constant speed synchronous electric motor is the drive mechanism for the pump.

(5) When the pump optimization system is first initialized on a gas engine driven rod pumping unit, the speed control mechanics described is switched to minimum speed by energizing an electro-pneumatic solenoid which regulates the fuel supply to cause the engine speed to be regulated at the preset adjusted minimum speed.

(6) The pump optimization system will then allow the gas engine to operate at minimum speed (previously set) for the adjusted time interval. At the end of this time interval, the pump optimization system (apparatus 11) will deenergize the electro-pneumatic solenoid to allow unrestricted fuel gas to the engine.

(7) With the unrestricted fuel supply, the gas engine speed will increase to that speed at which the governor is adjusted.

(8) The pumping system will run at this speed, controlled by the gas engine governor, until "pump-off" conditions are detected which will be manifested by a decrease in the actual liquid displaced each stroke by the subsurface pump 5 (FIG. 1).

(9) When "pump-off" conditions are detected by the pump optimization system the electro-pneumatic solenoid will again be energized which will reduce the speed once again to the minimum setting by routing the fuel gas supply through the fuel gas regulator which had been previously adjusted to minimum speed.

In the procedure described, the operator has the option of adjusting both the minimum and maximum speeds at which the pumping system is to be operated and the time interval at which the pumping system is to be run at minimum speed. The time interval during which the pumping system is run at the adjusted maximum speed is automatically determined by the pump optimization system to minimize "pump-off" conditions. This time interval will be a function of the pumping rate at minimum speeds, the time interval at which the pumping system is operated at minimum speeds, and the inflow performance of the reservoir.

The automatic means of switching the gas engine at one of the two adjustable speeds has the following advantages:

(1) The gas engine is run continuously avoiding any problems related to having to restart the gas engine in a START/STOP/START means of controlling pump capacities to match the inflow performance of the reservoir.

(2) The pumping system is regulated to minimize "pump-off" conditions to reduce wear by automatic switching between the minimum and maximum pumping speed.

(3) The time during which the pumping system runs at maximum adjusted speed will vary as reservoir inflow performance changes—as the inflow performance increases, the time during which the pump runs at maximum speed will increase automatically if no changes are made in the minimum speed and the time interval at which the pumping system is operated at minimum speed. Conversely, as the inflow performance of the reservoir diminishes for any reason, the time during which the pumping system will operate at maximum speed will be reduced automatically, assuming again that no change occurs to minimum speed or the time at which the system is pumped at minimum speed.

In effect, the pump optimization system when used to optimize the operation of gas engine driven rod pumped systems will automatically adjust the capacity of the pumping system by switching between maximum and minimum speeds to adapt to any change in the ability of the reservoir to deliver liquids to the well bore and/or to any change in the volumetric efficiency of the pumping system due to normal or abnormal wear or malfunction. For example: on each minimum and maximum speed run cycle, the pump optimization system (measurement apparatus 4 and electronic apparatus 11) provides data as follows:

(1) Volume pumped each liquid accumulation cycle of tanks 22 and 23 during minimum and maximum speed cycles.

(2) Average speed (stroke per minute) of the pump during each liquid accumulation cycle of tanks 22 and 23 during maximum and minimum speed cycles.

(3) Total volume of liquid pumped when the pumping system operates at minimum speed and the total volume of liquids pumped when the pumping system operates at maximum speed.

(4) Total number of strokes of the pump during a minimum pump speed cycle and the total number of strokes during a maximum pump speed cycle.

(5) The time the pumping system pumps during a minimum speed cycle and the time the pump operates during a maximum speed cycle.

(6) The total volume of liquids pumped, the number of strokes required for this pumped volume (at both minimum and maximum speed cycles) over longer time periods (several minimum/maximum speed cycles). (Example: 24 hours, 7 days, 30 days, etc.)

From the preceding listed data accumulated by electronic apparatus 11 during the accumulation of liquid cycle of tanks 22 and 23, during the maximum and minimum speed cycles of the pumping system which are controlled by electronic apparatus 11, and during longer time interval consisting of several minimum and maximum speed cycles, the following information may be computed and compared:

(1) Average actual liquids displaced (gallons per stroke) during each liquid accumulation cycle of tank 22 or 23 from the start to completion of a minimum speed pump cycle and of the maximum speed pump cycle.

(2) Average actual liquids displaced (gallons per stroke) during each minimum speed pump cycle and each maximum speed pump cycle.

(3) Increase or decrease of actual liquids displaced (gallons per stroke) each pump stroke from the start to finish of both the maximum speed cycle and the minimum speed pump cycle. Actual liquids displaced each stroke of the pump will tend to increase during a minimum speed pump cycle because of both the increasing submergence of the pump caused by liquid build-up in the annulus and the reduced speed of the pumping system. Conversely, the actual liquids displaced during the maximum speed pump cycle will tend to decrease because of both the diminishing submergence caused by the depletion of liquids in the annulus and the increased speed of the pumping system. By correlating both accumulated data and computed data from liquid accumulation cycle to liquid accumulation cycle of tank 22 or 23 and from minimum speed pump cycles to maximum speed pump cycles and over extended time period, the operator is able to detect or determine with excellent precision the following information:

(1) Loss of pump efficiency (gallons per stroke or percentage) over selected time intervals by comparing the difference in actual liquids displaced per stroke with the actual liquids displaced at some reference time event (usually when a new or repaired pump has been installed or other remedial effort has been implemented).

(2) Changes in efficiency (gallons per stroke or percentage) between the minimum speed pump cycle and the maximum speed pump cycle, and the change in efficiency during both the minimum speed pump cycle and the maximum speed pump cycle. This information will permit the operator to adjust both the minimum speeds and the time at which the pumping system operates at minimum speed and maximum speed to achieve optimum performance from the system and at the same time retain some capacity to adapt to any possible increase in reservoir inflow performance for whatever reason.

(3) Changes in volumes pumped during minimum and maximum speed pump cycles over long time periods (several minimum and maximum speed pump cycles). For example: If the total volume pumped during the present maximum and minimum speed pump cycle is 10 barrels and the time required to pump this volume is 30 minutes (total time of both the minimum and maximum speed cycles) and thirty days prior to the present min/max pump speed cycle, the total volume pumped was 15 barrels and the time required for pumping was 34 minutes, and from volumetric efficiency computations the pump efficiency is unchanged, the relative inflow performance of the reservoir from thirty days past and the present is as follows:

THIRTY DAYS PAST = (15/34) × 1440 = 635 BBLS per day

PRESENT CYCLE = (10/30) × 1440 = 480 BBLS per day

CHANGE = 635 − 480 = 155 BBLS per day (LOSS)

PERCENTAGE CHANGE = 155/635 = 24.4 percent loss

From the preceding examples it is obvious that changes in volumetric efficiencies (gallons per stroke change) can be determined by comparing average actual liquid displaced by the pump each stroke during each liquid accumulation cycle of tanks 22 and 23 with some reference average displacement value with the reference value being determined when the mechanical condition of the pump is known (usually after a new pump is installed or a worn pump is repaired).

In general, the volumetric efficiencies of the pump will decrease over extended time periods because of wear or other problems. As pump volumetric efficiencies decrease (gallons per stroke decrease), the maximum speed run time will automatically increase (assuming no change in reservoir inflow performance) to compensate for the loss in actual liquid displacement per stroke of the subsurface pump. There will also be some increase in liquid accumulation in the annulus (increase in pump submergence) because of decreasing pumping volumes during the minimum speed pump cycle due to decreasing pump volumetric efficiencies.

By comparing the volumetric efficiencies, the volumes pumped, and the time of the minimum and maximum speed pump cycles, changes in both the condition of the pump and the condition of the reservoir can be determined. This information provides the operator a means to quantitatively evaluate the mechanics of the pumping system for possible remedial effort, and, at the same time quantitatively evaluate the inflow performance of the reservoir for possible remedial action (stimulation, cleaning, chemical treatment, reservoir drive remedy). With this information available on each well within a field or reservoir, the operator is able to schedule remedial resources to those wells that yield optimum returns whether it be repairing the pumping systems or stimulating the reservoir to produce added liquids or both.

OPERATION OF THE OPTIONAL EMBODIMENTS OF THE PRESENT INVENTION

Optional embodiments of the present invention are illustrated in FIGS. 15, 16, 17, 18, 19, 20 and 21. FIG. 22, a rod pump speed sensing means is an added embodiment to both the preferred embodiment and the optional embodiments illustrated in FIGS. 15 through 21 inclusively.

Fundamentally, the mechanics and function of the present invention are not altered by the optional embodiments. The principal difference between the preferred embodiment and the optional embodiments of the present invention is as follows:

(1) The liquid quantity sensing means is changed to a sensing means that provides an electrical analog signal to electronic apparatus 11*a* representative of the quantity of liquids present in tanks 22 and 23.

(2) The sensing means for providing an analog signal to electronic apparatus 11*a* indicating the quantity of liquids present in tanks 22 and 23 are illustrated in FIGS. 17, 18 and 19. FIG. 17 is a load (weight) sensing transducer; FIG. 18 is a level sensing transducer; and FIG. 19 is a hydrostatic head (differential pressure) sensing transducer. In any of the three sensing means the analog signals will increase in the tank in which liquids are accumulating and will decrease in the tank in which the liquids are discharging. As a result, one of the transducers will be increasing while the other is decreasing.

(3) Electronic apparatus 11 (designated electronic apparatus 11*a* in the optional embodiment) is altered to accomodate and accept the analog signals from the liquid quantity sensing means 4*a* (FIGS. 15 and 16). This change to electronic apparatus 11 consists of adding signal conditioning circuits and an analog digital converter 46 (FIG. 20) to process and digitize the analog signals from any of the stated sensing means. The analog digital converter is controlled by microprocessor 36 to sample the analog signal at appropriate intervals to determine the quantity of liquids present in both tanks 22 and 23.

Other than the changes in the sensing means to determine the quantity of liquids in tanks 22 and 23 and the stated changes in electronic apparatus 11 (designated 11*a*) the operation and function of the measurement apparatus 4a and electronic apparatus 11a remain fundamentally the same.

Electronic apparatus 11a will process the analog signals from 70 and 71 (load transducers, FIG. 17) or 51 and 52 (level transducers, FIG. 18) or 60 (hydrostatic head transducer, FIG. 19). These signals are processed by 46 (signal conditioner and analog digital converter).

In the optional embodiment, the switching of the diverter mechanism 27 on the inlet lines 20 of tanks 22 and 23 and the diverter mechanism 28 on discharge lines 21 of tanks 22 and 23 is controlled by apparatus 11a rather than controller 29 as was the case in the preferred embodiment.

Diverter mechanisms 27 and 28 are controlled by microprocessor 36 in response to changes in the analog signals from the liquid quantity sensing means, or an elapsed time interval between switching of the diverter mechanisms, or the number of strokes of the pumping system. For example, the diverter mechanisms 27 and 28 may be controlled in response to any of the following events:

(1) When the analog signal from any of the liquid quantity sensing means discussed in either tank 22 or 23 exceeds a predetermined but adjustable magnitude.

(2) When the number of strokes of the pumping system (indicated by the number of switch closures of speed sensor 50, FIG. 22) reaches a predetermined but adjustable count.

(3) When the elapsed time from the switching of diverter mechanisms 27 or 28 exceeds some predetermined but adjustable time limit.

In all three of the listed events that may be employed to control the diverter mechanisms 27 and 28 of tanks 22 and 23 liquids accumulate in one tank (either tank 22 or 23) while being discharged from the other.

In case (1) where the magnitude of the analog signal controls the switching of diverter mechanisms 27 and 28, the time required for liquids to accumulate in either of the tanks will vary in the same manner as that described in the preferred embodiment. The advantage of employing an analog transducer to measure the quantity of liquids accumulating in tanks 22 and 23 lies in the fact that the quantity of liquids required to switch diverter mechanisms 27 and 28 is more easily and rapidly adjusted. The adjustment requires that the operator only use SELECT and ADJUST knobs (45 and 44) of panel 41 apparatus 11a to make this adjustment whereas in the preferred embodiment, a physical adjustment is required on measurement apparatus 4. In addition, the analog output of the liquid quantity sensing means of the optional embodiment may be sampled as frequently as may be practical and desirable to compute and compare the actual liquid displacement of the subsurface rod pump 5. In the preferred embodiment the computation of the actual liquids displaced may only be determined when enough liquids have accumulated in either tank 22 or 23 to actuate the liquid quantity sensing means to switch diverter mechanisms 27 and 28.

In case (2) listed for controlling the switching of diverter mechanisms 27 and 28, the number of strokes of the pumping system is fixed (adjusted). This means that the quantity of liquids accumulated in either tank 22 or 23 will be a function of the volumetric efficiency of the pump. At the end of a fixed number of strokes (adjusted by the operator using the SELECT and ADJUST knobs, 45 and 44) the quantity of liquids is determined by sampling and processing the analog signal indicating the quantity of liquid in either tank 22 or 23 whichever is accumulating liquids. With the number of strokes known (controlled) and the quantity of liquid pumped known for this fixed number of strokes, the average actual liquid displaced by the pump is easily determined. This determination of actual liquids displaced may then be compared with some reference displacement (manually input by the operator or automatically determined during the initial liquid accumulation cycle of the START/STOP/START pumping cycle. By using a fixed number of strokes to control the switching of diverter mechanisms 27 and 28 of tanks 22 and 23, the speed of the pump may be changed at any time without affecting the ability of the pump optimization system to detect decreases in volumetric efficiencies.

In case (3) listed, the time interval for switching diverter mechanisms 27 and 28 is fixed (adjustable by the operator using SELECT and ADJUST knobs, 44 and 45, control panel 41, apparatus 11a FIGS. 20 and 21). This means that the liquid quantity accumulating in tank 22 or 23 at time diverter mechanisms 27 and 28 are switched will vary with a charge in both the volumetric efficiency and speed of the pump. If the volumetric efficiency decreases during this fixed time interval the amount of liquid accumulated will be less. If the speed (strokes per minute) decreases, the amount of liquid accumulated at the end of the fixed switching interval will be less. This method of controlling diverter mechanisms 27 and 28 (fixed time interval) while being simple in concept, has the limitation of being sensitive to changing pump speeds when the optimization system is used to determine the time and magnitude of pump volumetric efficiency change.

However, if speed sensor 50, FIG. 22, is employed to measure speed, the volumetric efficiency of the pumping system may be determined after a fixed (adjustable) number of strokes (Example: 1 to 10) while still switching diverter mechanisms 27 and 28 after a fixed but adjustable elapsed time limit.

The major advantages of the optional embodiments consisting of an optional analog snesing means to continuously detect the quantity of liquids accumulating and discharging in tanks 22 and 23 lies in the increased number and variety of techniques that can be employed to monitor and analyze the pumping system, the near well bore mechanics of the reservoir, and the mechanics of the reservoir drive throughout the field.

Another feature that may be implemented using the optional embodiment of instrumentation and analysis is as follows:

CONTROL OF SPEED OF ELECTRIC MOTOR DRIVEN ROD PUMP SYSTEMS

On those rod pump systems that are driven with synchronous electric motors and are equipped with a variable frequency drive controller, the optional embodiment of the pump optimization system may be used to control the speed of the pumping system to keep the well pumped down (liquid level in the annulus at or near pump inlet but not "pumped-off"). The technique of controlling speed to control pump capacity rather than controlling pumping time has several advantages.

(a) At reduced speeds, the volumetric efficiency improves with no change in pump submergence. This minimizes electrical power consumption.

(b) Dynamic horsepower is less at reduced speeds which also decreases electric power consumption.

(c) Reduced speeds minimize stress and shock to all affected parts of the pumping system (rods, tubing, balls, and seats). This decreases wear and maintenance.

Control of speed may be accomplished by increasing and decreasing speeds to determine that the liquid level in the annulus is at or near the pump inlet by observing (automatically-utilizing microprocessor 36) abnormal changes in pump volumetric efficiencies as speeds are increased and decreased.

While there are other possible embodiments that would improve the subject invention, it should be obvious that the function and intent of the present invention is to measure the liquid quantities pumped by a rod pumping well using a novel method of measuring these liquids where liquids and gases are present in the flow stream. Another obvious and novel feature of the measurement apparatus of the subject invention is that restrictions to pumping and flowing fluids are minimized by maintaining a fully open inlet and outlet to and from the measurement apparatus. This feature also insures that flow from the well will never be interrupted due to any mechanical failure of the measurement apparatus or the apparatus controlling the measurement apparatus. The subject invention may also include an electronic apparatus which provides the means to analyze the rate at which liquids are pumped for the purpose of determining changes in the ability of the reservoir to deliver liquids to the well bore, and for the purpose of controlling the capacity of the pumping system in response to any change in the efficiency of the pumping system or change in the reservoir by controlling the speed of the pumping system, or controlling the time the pumping system pumps, or controlling both the time the well is pumped and the speed of the pumping system to maintain the operation of the pumping system and the well at optimum conditions.

We claim:

1. A liquid measurement apparatus for measuring liquid quantities in a fluid flow stream containing both liquids and gases and comprising two containers each of which has an inlet and outlet line for the flowing fluids and a connecting conduit between the two containers to allow any gases contained in said fluid flow stream to separate in either of said two containers to pass to the other while accumulating liquids in one of said two containers and a mechanism on the said inlet and outlet lines of the said two containers to alternately divert said flowing fluids to and from the said two containers such that fluid is flowing into one of said two containers while simultaneously discharging from the other and a sensing means located in each of the said two containers to detect when a quantity of liquids accumulate in the one of said two containers into which fluids are flowing and to provide a signal when said quantity of liquids has accumulated and a control and recording means to accept said signals alternately from both said sensing means to record said liquid quantity signals when liquids alternately accumulate in each of said two containers to divert said flowing fluids to and from the opposite of the said two containers when said control and recording means receives a signal from said sensing means from either of said two containers.

2. The liquid measurement apparatus of claim 1 wherein the said mechanism on said inlet and outlet lines of said two containers is a pneumatically operated valve that will alternately divert said flowing fluids to and from said two containers such that fluid is flowing into one of said two containers while simultaneously discharging from the other with said pneumatically operated valve constructed so as to be operated by a single pneumatic operator and such that no position of the valve or pneumatic operator will restrict said flowing fluids from the inlet to the outlet of said liquid measurement apparatus.

3. The liquid measurement apparatus of claim 1 wherein the said mechanism on said inlet and outlet lines of said two containers is an electric motor operated valve that will alternately divert said flowing fluids to and from said two containers such that fluid is flowing into one of said two containers while simultaneously discharging from the other with said electric motor operated valve constructed so as to be operated by a single electric motor and such that no position of the valve or electric operator will restrict said flowing fluids from the inlet to the outlet of said liquid measurement apparatus.

4. The liquid measurement apparatus of claim 1 wherein said sensing means for each of the said two containers is a level sensing means consisting of a float that will provide an electrical signal when the liquid level in the said two containers reaches the level in the said containers at which the float is positioned.

5. The liquid measurement apparatus of claim 1 wherein said sensing means for each of the said two containers is a hydrostatic head sensing switch that will provide an electrical signal when the hydrostatic head of each of said two containers accumulates liquids which exceed the fixed and adjustable limit of the hydrostatic head switch.

6. The liquid measurement apparatus of claim 1 wherein said sensing means for each of the said two containers is a weight sensing means whereby each of the sensing means will provide an electrical signal when the increase in weight of either of the two said containers exceeds a fixed but adjustable weight limit caused by liquids accumulating in either of said two containers.

7. An apparatus for determining actual liquid displacement quantities of a subsurface reciprocating oil well pumping system to detect changes in actual liquids displaced by the pump over short and long time periods for the purpose of analyzing and managing pump and reservoir performance comprising an electronic apparatus for receiving electrical signals representative of a quantity of liquids being pumped from some liquid measurement apparatus and a select and display means for said electronic apparatus to select and display data associated with the reception of said electrical signals representative of a quantity of liquids being pumped and a select and limit entry means for said electronic apparatus to select and enter timing limits associated with the reception of said electrical signals representative of a quantity of liquids being pumped and timing limits associated with the on and off control of the pumping system and a monitoring means for said electronic apparatus to monitor elapsed time and/or number of pumping strokes between said electrical signals representative of a quantity of liquids being pumped to detect when said elapsed time and/or number of pumping strokes between said electrical signals representative of a quantity of liquids being pumped exceeds fixed but adjustable timing limits and a control means for said electronic apparatus to turn off said oil well pumping system when said monitoring means detects when said elapsed time and/or number of pumping strokes between electrical signals representative of a quantity of liquids being pumped exceeds said limit and to leave said oil well pumping system turned off for a fixed but adjustable time limit before restarting said oil well pumping system.

8. The apparatus of claim 7 wherein said electronic apparatus includes a recording means to record the following elapsed times (a) said elapsed time and number of pumping strokes between said electrical signals representative of a quantity of liquids being pumped for the current operating oil well pumping system run cycle and a plurality of previous run cycles (b) elapsed time and number of pumping strokes between the restarting of said oil well pumping system after said oil well pumping system has been turned off by said control means for said time limit and the reception of first said electrical signal representative of a quantity of liquids being pumped for the current run cycle and a plurality of previous run cycles (c) elapsed time and number of pumping strokes between the restarting of said oil well pumping system by said control means and the time said oil well pumping system is turned off by said control means for the current run cycle and a plurality of previous run cycles.

9. The apparatus of claim 8 wherein said electronic apparatus will accumulate and record said elapsed times of said oil well pumping system run cycles for a plurality of time intervals.

10. The apparatus of claim 7 wherein said electronic apparatus includes a recording means of accumulating and recording received said electrical signals representative of a quantity of liquids being pumped for the current run cycle of said oil well pumping system and a plurality of previous run cycles.

11. The apparatus of claim 10 wherein said recording means of said electronic apparatus will accumulate and record received electrical signals representative of a quantity of liquids being pumped for a plurality of time intervals.

12. An apparatus for determining actual liquid displacement quantities of a subsurface reciprocating oil well pumping system to detect changes in actual liquids displaced by the pump over short and long time periods for the purpose of analyzing and managing pump and reservoir performance comprising an electronic apparatus for receiving electrical signals representative of a quantity of liquids being pumped (from some liquid measurement apparatus) and for receiving electrical status signals indicating said oil well pumping system is running or not running and a select and display means for said electronic apparatus to select and display data associated with the reception of said electrical signals representative of a quantity of liquids being pumped and data associated with said electrical status signals indicating said oil well pumping system is running or not running and a select and limit entry means for said electronic apparatus to select and enter limits associated with the reception of said electrical signals representative of a quantity of liquids being pumped and a monitoring means for said electronic apparatus to monitor elapsed time and number of pumping strokes between said electrical signals representative of a quantity of liquids being pumped to detect an event when said elapsed time and/or number of pumping strokes between said electrical signals representative of a quantity of liquids being pumped exceeds fixed but adjustable preset limits and a recording means for said electronic apparatus to record said number of electrical signals, elapsed times associated with said electrical signals, with said event detected by said monitoring means, and said electrical status signals for the current run cycle and a plurality of previous run cycles with the cycles being controlled by an external manually adjustable interval timer including (a) said elapsed time and number of pumping strokes between said electrical signals representative of a quantity of liquids being pumped (b) elapsed time and number of pumping strokes between the reception of said status signal indicating said oil well pumping system is running and the reception of the first said electrical signal representative of a quantity of liquids being pumped (c) elapsed time and number of pumping strokes between the reception of said status signal indicating said oil well pumping system is running and the time said monitoring means detects said event when said elapsed time and/or number of pumping strokes between said electrical signals representative of a quantity of liquids being pumped exceeds said preset elapsed limit (d) elapsed time and number of pumping strokes between the reception of said status signal indicating said oil well pumping system is running and the time of reception of said status signal indicating said oil well pumping system is not running (e) elapsed time between the time of reception of said status signal indicating said oil well pumping system is not running and the time of reception of said status signal indicating said oil well pumping system is running.

13. The apparatus of claim 12 wherein said recording means of said electronic apparatus will accumulate and record said electrical signals representative of a quantity of liquids being pumped and number of pumping strokes separately during each of the following elapsed times of the current run cycle and a plurality of previous run cycles with the cycles being controlled by an external manually adjustable interval timer (a) the elapsed time from the reception of said electrical status signal indicating the said oil well pumping system is running until the time said monitoring means detects said event when said elapsed time between electrical signals representative of a quantity of liquids being pumped exceeds said preset elapsed limit (b) the elapsed time from when said monitoring means detects said event when said elapsed time and/or number of pumping strokes between said electrical signals representative of a quantity of liquids being pumped exceeds said preset limit until reception of said electrical status signal indicating said oil well pumping system is not running (c) the elapsed time from the reception of said electrical status signal indicating said oil well pumping system is running until reception of said electrical status signal indicating said oil well pumping system is not running.

14. The apparatus of claim 13 wherein said recording means of said electronic apparatus will, in addition, separately accumulate and record said elapsed times during previous run cycles being controlled by an external manually adjustable interval timer for a plurality of time intervals.

15. The apparatus of claim 14 wherein said recording means of said electronic apparatus will, in addition, separately accumulate and record said electrical signals representative of a quantity of liquids being pumped for said elapsed times during previous run cycles controlled by an external manually adjustable interval timer for a plurality of time intervals.

16. A liquid measurement apparatus for measuring liquid quantities of fluids pumped by a subsurface reciprocating oil well pumping system when said fluids contain both liquids and gases with said liquid measurement apparatus including a means to determine liquid displacement quantities of said pumping system to detect changes in said liquid displacement for the purpose of analyzing and managing pump and reservoir performance comprising two containers each of which has an inlet and outlet line for the pumped fluids and a connecting conduit between the two containers to allow any gases contained in said pumped fluids to pass from either of said two containers to the other while accumulating liquids in the opposite of said two containers and a mechanism on the said inlet and outlet lines of the said two containers to alternately divert said flowing fluids to and from the said two containers such that fluid is being pumped into one of said two containers while simultaneously discharging from the other and a sensing means for each of the said two containers to provide analog signals representative of the quantity of liquids present in each of said two containers and an electronic apparatus to accept and process said analog signals from each of said sensing means of said two containers to determine actual liquid displacement of said oil well pumping system for some preset and adjustable plurality of strokes of the subsurface reciprocating pumping system and a select and display means for said electronic apparatus to select and display data associated with the processing of said analog signals to determine actual pump displacement and the volume of liquids pumped over a plurality of time intervals and number of strokes of the subsurface pump and a select and limit entry means for said electronic apparatus to select and enter limits associated with the processing of said analog signals and the control of said oil well pumping system to improve performance and a control means for said electronic apparatus to cause said mechanism on the inlet and outlet lines to said two containers to divert said pumped fluids to and from the opposite of said two containers when the number of strokes of the pumping system equals preset entered limits and a control means for said electronic apparatus to cause said oil well pumping system to be shut down when the actual liquid displacement of said reciprocating pumping system falls below an adjustable entered limit.

17. The apparatus of claim 16 wherein said electronic apparatus includes a recording means to record the following (a) quantity of liquids pumped by said subsurface reciprocating pump for the plurality of strokes determined by entered limits (b) average displacement quantity per stroke for the plurality of strokes determined by entered limits (c) displacement efficiency of said subsurface reciprocating pump system with respect to theoretical subsurface pump displacement and with respect to actual attainable pump displacement with known submergence and known pump inefficiencies during filling of each of said two containers for the plurality of strokes determined by entered limits for a plurality of said two container filling events that occur from the starting of the pumping system to the stopping of the pumping system and over specified plurality of time intervals (d) displacement efficiencies when the subsurface pumping system is initially installed in the well and at specified time intervals during the operating life of the pumping system or until repairs or modifications are made to the pumping system (e) quantities of liquids pumped, number of strokes required for pumping said quantities of liquid pumped, number of pump system start to stop cycles, time pump system was running and time pump system was stopped for specified time intervals and specified number of pump system start to stop cycles.

18. The apparatus of claim 16 wherein said mechanism on said inlet and outlet lines of said two containers to divert said flowing fluids is a pneumatically actuated diverting mechanism constructed such that flow of fluids from the inlet to the outlet of the said two containers cannot be restricted because of the position of the diverter mechanism or the position of the pneumatic operator.

19. The apparatus of claim 16 wherein said mechanism on said inlet and outlet lines of said two containers to divert said flowing fluids is an electric motor actuated diverter mechanism constructed such that a single electric motor will actuate the diverter mechanism for both of two said containers and such that flow of fluids from the inlet to the outlet of said two containers cannot be restricted because of the position of the diverter mechanism or the position of the electric motor driving the diverter mechanism.

20. The apparatus of claim 16 wherein said sensing means of each of said two containers is a level sensing means that provides analog signals representative of the level of liquids in each of said two containers.

21. The apparatus of claim 16 wherein said sensing means is a hydrostatic head sensing means that provides analog signals representative of the hydrostatic head in each of the two said containers.

22. The apparatus of claim 16 wherein said sensing means for each of said two containers is a weight sensing means that provides analog signals representative of the weight of each of said two containers and their fluid contents.

* * * * *